US012137809B2

(12) United States Patent
Stokesbary et al.

(10) Patent No.: US 12,137,809 B2
(45) Date of Patent: Nov. 12, 2024

(54) ADJUSTABLE BED BASE WITH INCLINE/DECLINE FEATURE

(71) Applicant: L&P Property Management Company, South Gate, CA (US)

(72) Inventors: Jason J. Stokesbary, Joplin, MO (US); Jacob J. Neuenswander, Carthage, MO (US); Isaac T. Freelend, Sarcoxie, MO (US); Galen B. Wilkinson, Carl Junction, MO (US)

(73) Assignee: L&P Property Management Company, South Gate, CA (US)

( * ) Notice: Subject to any disclaimer, the term of this patent is extended or adjusted under 35 U.S.C. 154(b) by 369 days.

(21) Appl. No.: 17/846,162

(22) Filed: Jun. 22, 2022

(65) Prior Publication Data

US 2023/0363544 A1 Nov. 16, 2023

Related U.S. Application Data

(63) Continuation-in-part of application No. 17/744,885, filed on May 16, 2022, now Pat. No. 11,930,933.

(51) Int. Cl.
*A47C 20/04* (2006.01)
*A47C 20/08* (2006.01)

(52) U.S. Cl.
CPC ..... *A47C 20/041* (2013.01); *A47C 20/08* (2013.01)

(58) Field of Classification Search
CPC ..... A47C 20/041; A47C 20/08; A47C 19/045
USPC ..... 5/616
See application file for complete search history.

(56) References Cited

U.S. PATENT DOCUMENTS 4,494,259 A * 1/1985 Miller ..... A47C 20/08 5/616
4,715,073 A * 12/1987 Butler ..... A61G 7/005 5/607
4,856,129 A * 8/1989 Butler ..... A47C 19/045 5/509.1
5,294,179 A * 3/1994 Rudes ..... A61G 5/14 297/DIG. 10
5,566,412 A * 10/1996 Arnold ..... A47C 19/045 5/509.1
6,516,478 B2 * 2/2003 Cook ..... A47C 19/045 5/616
6,851,144 B2 * 2/2005 Wang ..... A61G 7/015 5/616
6,957,456 B2 * 10/2005 Darling ..... A47C 19/045 5/509.1
7,146,662 B1 * 12/2006 Pollard ..... A47B 91/16 5/118
2002/0178501 A1 * 12/2002 Cook ..... A47C 19/045 5/611

(Continued)

*Primary Examiner* — Justin C Mikowski
*Assistant Examiner* — Luke Hall

(57) ABSTRACT

An adjustable bed base has a subframe assembly including a subframe which may be inclined relative to a stationary frame by a primary linear actuator. An articulating deck is attached to the subframe. Secondary linear actuators articulate the deck. The subframe assembly is pivotally secured to a portion of the stationary frame. The subframe may be inclined by extending the primary linear actuator which moves ramps, causing wheels attached to the subframe to ride upwardly along the ramps, thereby raising the head end of the subframe relative to the stationary frame.

20 Claims, 21 Drawing Sheets

(56) References Cited

U.S. PATENT DOCUMENTS

| | | | | |
|---|---|---|---|---|
| 2003/0052238 | A1* | 3/2003 | Schneider | A47C 20/08<br>248/421 |
| 2003/0172756 | A1* | 9/2003 | Dewert | A47C 20/041<br>74/89.23 |

* cited by examiner

ADJUSTABLE BED BASE WITH INCLINE/DECLINE FEATURE

CROSS-REFERENCE TO RELATED APPLICATIONS

This application is a Continuation-In-Part of U.S. patent application Ser. No. 17/744,885 filed May 16, 2022 (pending), the disclosure of which is incorporated by reference herein.

FIELD OF THE INVENTION

This invention relates generally to bedding products and, more particularly, to an adjustable bed base having a subframe which may be tilted either forwardly or rearwardly.

BACKGROUND OF THE INVENTION

Conventional adjustable bed bases often have a stationary frame supported by leg assemblies. Such adjustable bed bases typically include a deck supported by the stationary frame. The deck supports a mattress. The deck usually comprises multiple deck members hinged together. One of the deck members, commonly a seat deck member, is commonly fixedly secured to the stationary frame. A head deck member is typically hinged to the seat deck member. A first motorized linear actuator inclines the front end of the head deck member so a user may sit up and read or watch television in an inclined position.

A leg deck member is commonly hinged to the stationary seat deck member and a foot deck member hinged to the leg deck member. A second motorized linear actuator serves to incline the leg and foot deck members around a person's knees for comfort.

One drawback to such common adjustable bed bases is that the articulated deck is always horizontal when the deck members are aligned or flat. There is no mechanism to either incline or decline the articulated deck when the deck members are all flat and aligned. Persons with health issues such as circulation issues or gastroesophageal reflux disease ("GERD") issues may desire a flat platform which is inclined such that the head end is above the foot end of the platform. Other health conditions or situations may require that the flat platform be inclined such that the head end of the platform is above the foot end of the deck platform or declined such that the head end of the platform is below the foot end of the deck platform.

In view of the above, there is a need for an adjustable bed base having an upper frame which is adjustable relative to a stationary lower frame. There is further a need for an adjustable bed base which is capable of inclining or declining the articulated deck of the adjustable bed base when the articulated deck is flat or planar using movable ramps.

It is therefore an objective of this invention to provide an adjustable bed base having an upper frame which may be inclined or declined relative to a stationary lower frame using movable ramps.

It is further an objective of this invention to provide an adjustable bed base having an upper frame which may be inclined or declined relative to a lower stationary frame using movable ramps regardless of the position of the deck members.

SUMMARY OF THE INVENTION

According to one aspect of the invention, an adjustable bed base comprises a generally rectangular stationary frame having opposed side rails, a head rail, a foot rail and a middle rail. Each of the side rails have a C-shaped cross-section defining a channel. Legs which may or may not be adjustable in height are secured to the stationary frame for supporting the stationary frame.

The adjustable bed base further comprises a subframe or upper frame which is movable relative to the stationary frame. The subframe comprises opposed side members, a front member, a rear member and a cross member extending between the opposed side members.

The adjustable bed base further comprises an articulated deck comprising a head deck board, a seat deck board, a leg deck board and a foot deck board hinged together. The seat deck board is secured to the side members of the subframe and remains stationary regardless of the positions of the other deck boards. Alternatively, the seat deck board may be secured to any portion of the subframe. The boards may be made of wood, plastic or any known material. A head brace is secured to the head deck board and a leg brace is secured to the leg deck board. In one embodiment, the head and leg braces are each generally U-shaped comprising at least three metal members. Each brace provides an anchor for the secondary linear actuators and functions to strengthen the respective board member to which it is attached.

The adjustable bed base further comprises two front ramps and two rear ramps. Each of the ramps is moveable inside one of the channels of one of the side rails of the stationary frame.

The adjustable bed base further comprises two front rotatable wheels. Each of the front rotatable wheels is secured to a mounting bracket secured to the front member of the subframe. Each of the front rotatable wheels is sized and adapted to move inside a groove of one of the front ramps.

The adjustable bed base further comprises two rear rotatable wheels. Each of the rear rotatable wheels is secured to a mounting bracket secured to the rear member of the subframe. Each of the rear rotatable wheels is sized and adapted to move inside a groove of one of the rear ramps.

The adjustable bed base further comprises two front primary linear actuators for moving the front ramps from front to back inside the channels of the side rails of the stationary frame. Each of the front primary linear actuators functions to raise and lower a front portion of the subframe, pivoting the subframe about a rear pivot axis defined by the rotation axes of the rear wheels. Each of the front primary linear actuators has a first end pivotally secured to an anchor inside one of the side rails of the stationary frame. Each of the front primary linear actuators has a second end pivotally secured to a mounting bracket secured to one of the front ramps. Upon being activated the front primary linear actuators extend forward simultaneously, pushing the front ramps forwardly, causing the front ramps to move forwardly and the front rotatable wheels to move up the grooves in the front ramps. The movement of the front ramps raises the rotatable front wheels which raises the front member of the subframe. Thus, movement of the rotatable front wheels up the grooves of the front ramps pivots the subframe about the rear pivot axis relative to the stationary frame, causing the subframe to incline.

The adjustable bed base further comprises two rear primary linear actuators for moving the rear ramps from front to back inside the channels of the side rails of the stationary frame. Each of the rear primary linear actuators functions to raise and lower a rear portion of the subframe, pivoting the subframe about a front pivot axis. The front pivot axis is defined by the rotation axes of the front wheels. Each of the rear primary linear actuators has a first end pivotally secured to an anchor inside one of the side rails of the stationary frame. Each of the rear primary linear actuators has a second end pivotally secured to a mounting bracket secured to one of the rear ramps. Upon being activated the rear primary linear actuators extend backward simultaneously, pushing the rear ramps rearwardly, causing the rear ramps to move rearwardly and the rear rotatable wheels to move up the grooves in the rear ramps. The movement of the rear ramps raises the rotatable rear wheels which raises the rear member of the subframe. Thus, movement of the rotatable rear wheels up the grooves of the rear ramps pivots the subframe about the front pivot axis relative to the stationary frame, causing the subframe to decline.

The adjustable bed base further comprises front and rear secondary linear actuators. A front secondary linear actuator functions to incline the head deck board. The front secondary linear actuator has a first end pivotally secured to a mounting bracket secured to the cross member of the subframe. The second end of the front secondary linear actuator is pivotally secured to the head brace.

A rear secondary linear actuator functions to incline the leg and foot deck boards. The rear secondary linear actuator has a first end pivotally secured to a mounting bracket secured to the rear member of the subframe. The rear secondary linear actuator has a second end pivotally secured to the leg brace.

The four linear actuators are preferably motorized. The subframe, whether the deck is articulated or flat, is inclined when the front primary linear actuators are extended. The maximum incline or tilt occurs when the front primary linear actuators are fully extended and the rear primary linear actuators are fully withdrawn or contracted. The subframe is horizontal when all four primary linear actuators are fully withdrawn or contracted. The front primary linear actuators function to incline the subframe regardless of whether the deck members are fully inclined or flat or any position therebetween. The rear primary linear actuators function to decline the subframe regardless of whether the deck members are fully inclined or flat or any position therebetween.

Worded another way, the adjustable bed base comprises a stationary frame having opposed side rails, a head rail, a foot rail and a middle rail. Each of the side rails have a C-shaped cross-section defining a channel. Legs, which may or may not be adjustable in height, support the stationary frame.

The adjustable bed base further comprises two front ramps and two rear ramps. Each of the ramps is moveable inside one of the channels of one of the side rails of the stationary frame.

The adjustable bed base further comprises a subframe having opposed side members, a front member, a rear member and a cross member. Rotatable wheels are secured to wheel mounting brackets which are secured to the front and rear members of the subframe. Each of the rotatable wheels is sized and adapted to move along one of the ramps.

The adjustable bed base further comprises a deck comprising a head deck board, a seat deck board, a leg deck board and a foot deck board hinged together. The seat deck board is secured to the subframe and remains stationary regardless of the positions of the other deck boards. A head brace is secured to the head deck board and a leg brace is secured to the leg deck board. Each brace provides a connecting location for one of the secondary linear actuators and functions to strengthen the respective board member to which it is attached.

The adjustable bed base further comprises a primary linear actuator corresponding to each of the ramps for moving the ramp. The primary linear actuator has a first end pivotally secured to an anchor secured inside one of the side rails of one of the channels of one of the side rails of the stationary frame. The primary linear actuator has a second end pivotally secured to a mounting bracket secured to one of the ramps.

Upon being activated the front primary linear actuators extend forward simultaneously, pushing the front ramps forwardly, causing the front ramps to move forwardly and the rotatable front wheels to move up the front ramps. The forward movement of the front ramps raises the rotatable front wheels which raises the front member of the subframe. Thus, movement of the rotatable wheels up the front ramps pivots the subframe about a rear pivot axis relative to the stationary frame, causing the subframe to incline. The rear pivot axis is defined by the rotational axes of the rear wheels.

To decline the subframe relative to the stationary frame, the rear primary linear actuators are activated to extend them rearwardly simultaneously, pushing the rear ramps backwardly, causing the rear ramps to move rearwardly and the rotatable rear wheels to move up the rear ramps. The rearward movement of the rear ramps raises the rotatable rear wheels which raises the rear member of the subframe. Thus, movement of the rotatable rear wheels up the rear ramps pivots the subframe about a front pivot axis relative to the stationary frame, causing the subframe to decline. The front pivot axis is defined by the rotational axes of the front wheels.

The adjustable bed base further comprises front and rear secondary linear actuators as described above for purposes of movement of the deck boards.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
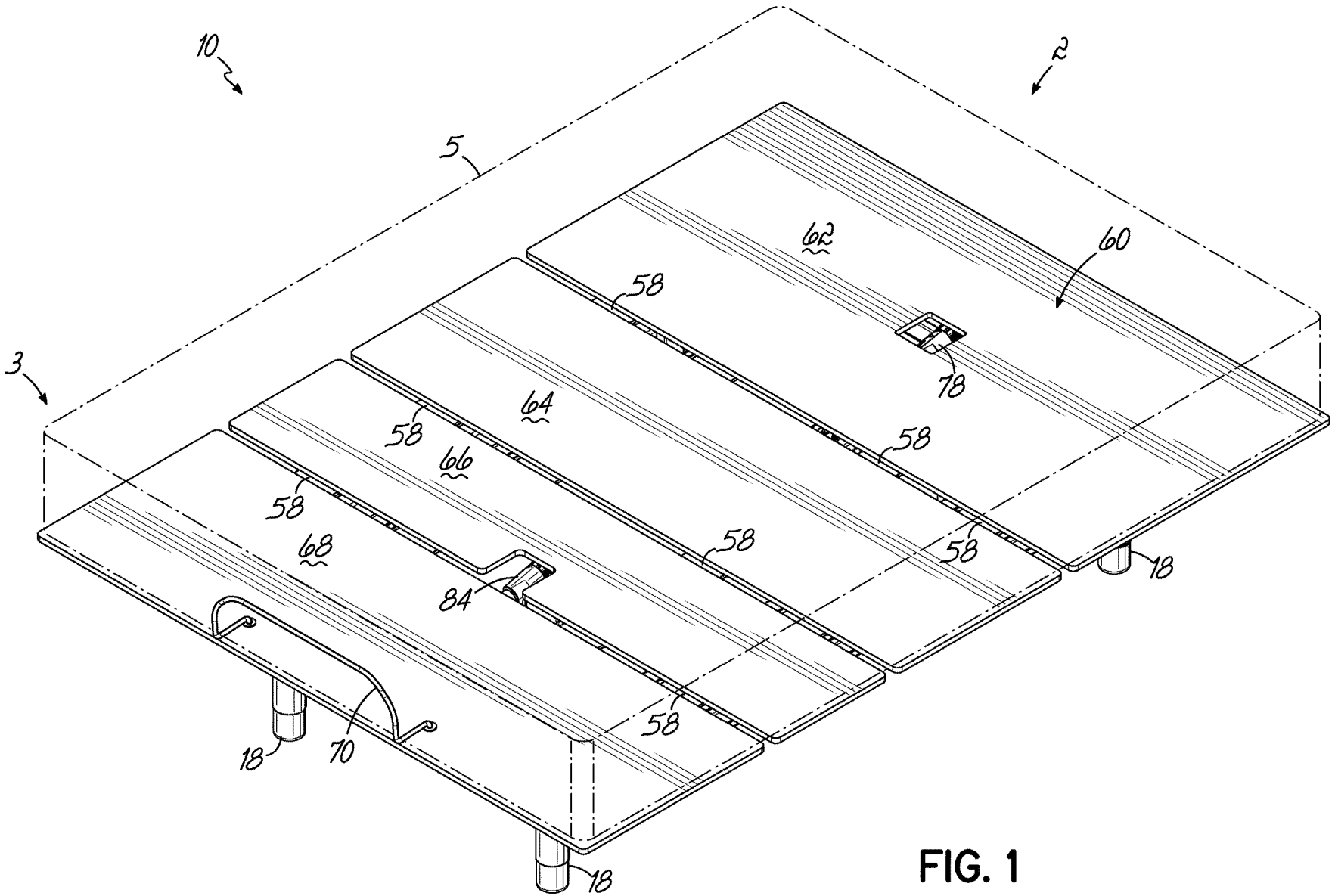
FIG. 1 is a top perspective view of an adjustable bed base.

Referring to FIG. 1, an adjustable bed 10 includes an adjustable bed base 12 for supporting a mattress 5. The adjustable bed base 12 has a head end 2 and a foot end 3. The adjustable bed base 12 of the present invention may be used with any type of mattress. The mattress is not intended to be limited by the drawings.

Figure 2:
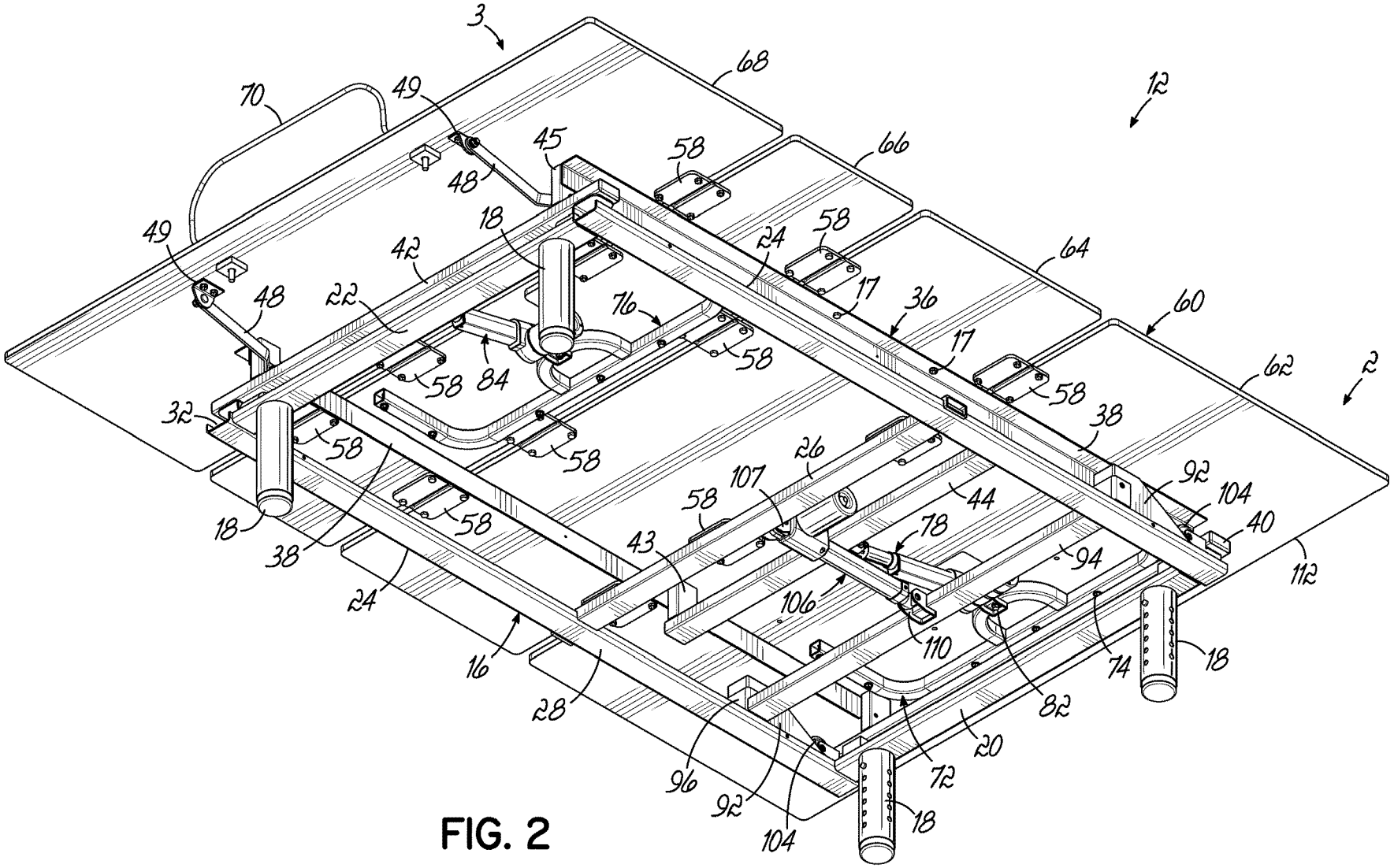
FIG. 2 is a bottom perspective view of the adjustable bed base of FIG. 1.

As best shown in FIG. 2, the adjustable bed base 12 comprises a generally rectangular stationary frame 16 supported by leg assemblies or legs 18. The leg assemblies 18 are illustrated as being adjustable in height. Although one type of leg assembly 18 is illustrated supporting the adjustable bed base 12, any other type of leg assembly including unitary legs not adjustable in height may be used in accordance with the present invention. The legs of the adjustable bed base are not intended to be limited by the drawings.

Figure 5:
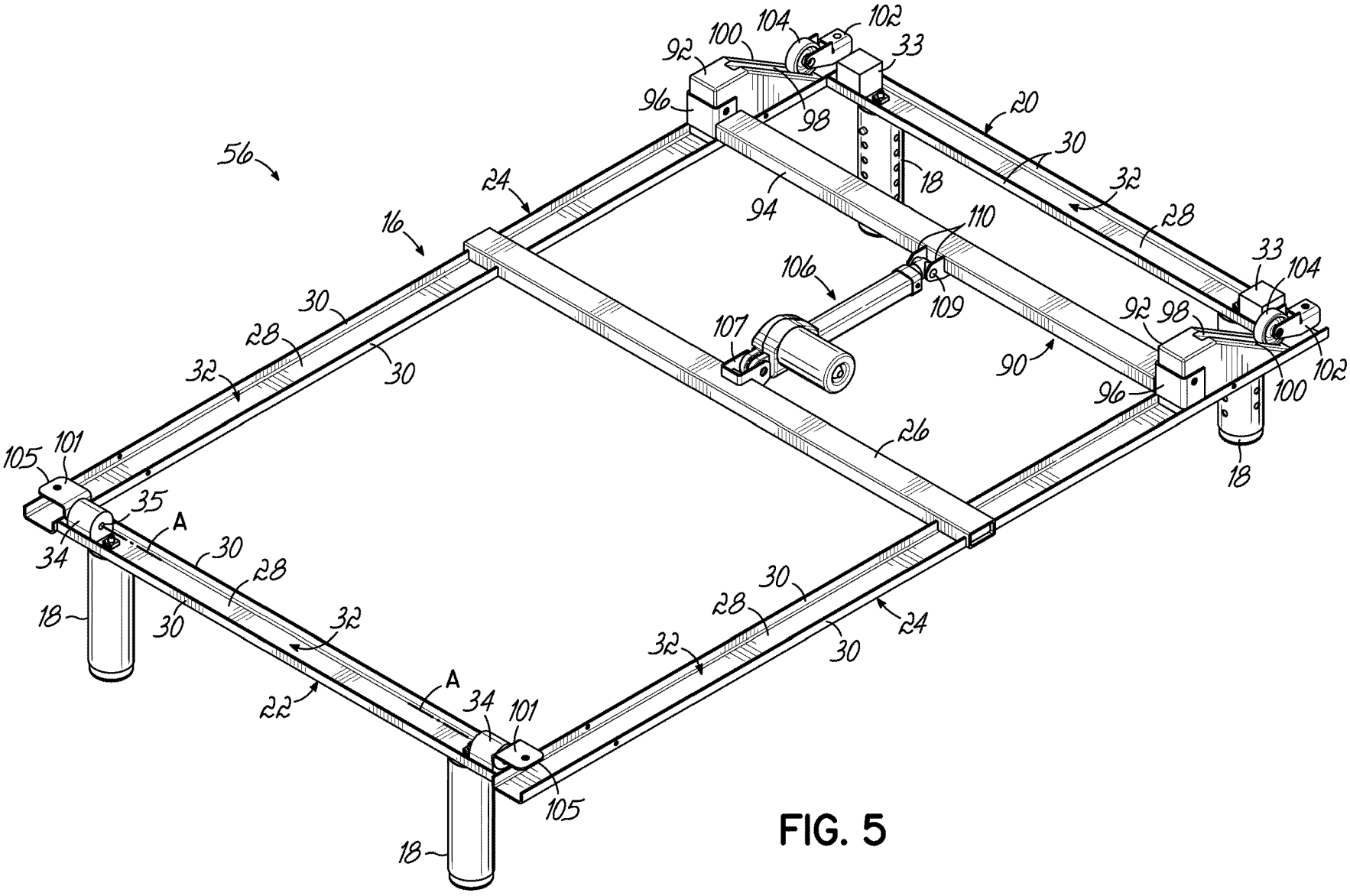
FIG. 5 is a perspective view of a portion of the frame assembly.

As best shown in FIG. 5, the generally rectangular stationary frame 16 comprises a head rail 20, a foot rail 22 and two opposed side rails 24. The head rail 20 and foot rails 22 each extend between the opposed side rails 24. As best shown in FIG. 5, the generally rectangular frame 16 further comprises a middle rail 26 extending between the opposed side rails 24. As best shown in FIG. 5, each of the side rails 24, the head rail 20 and foot rail 22 each have a C-shaped cross section comprising a bottom wall 28 and two side walls 30 extending upwardly from the bottom wall 28 which define a channel 32.

Figure 5A:
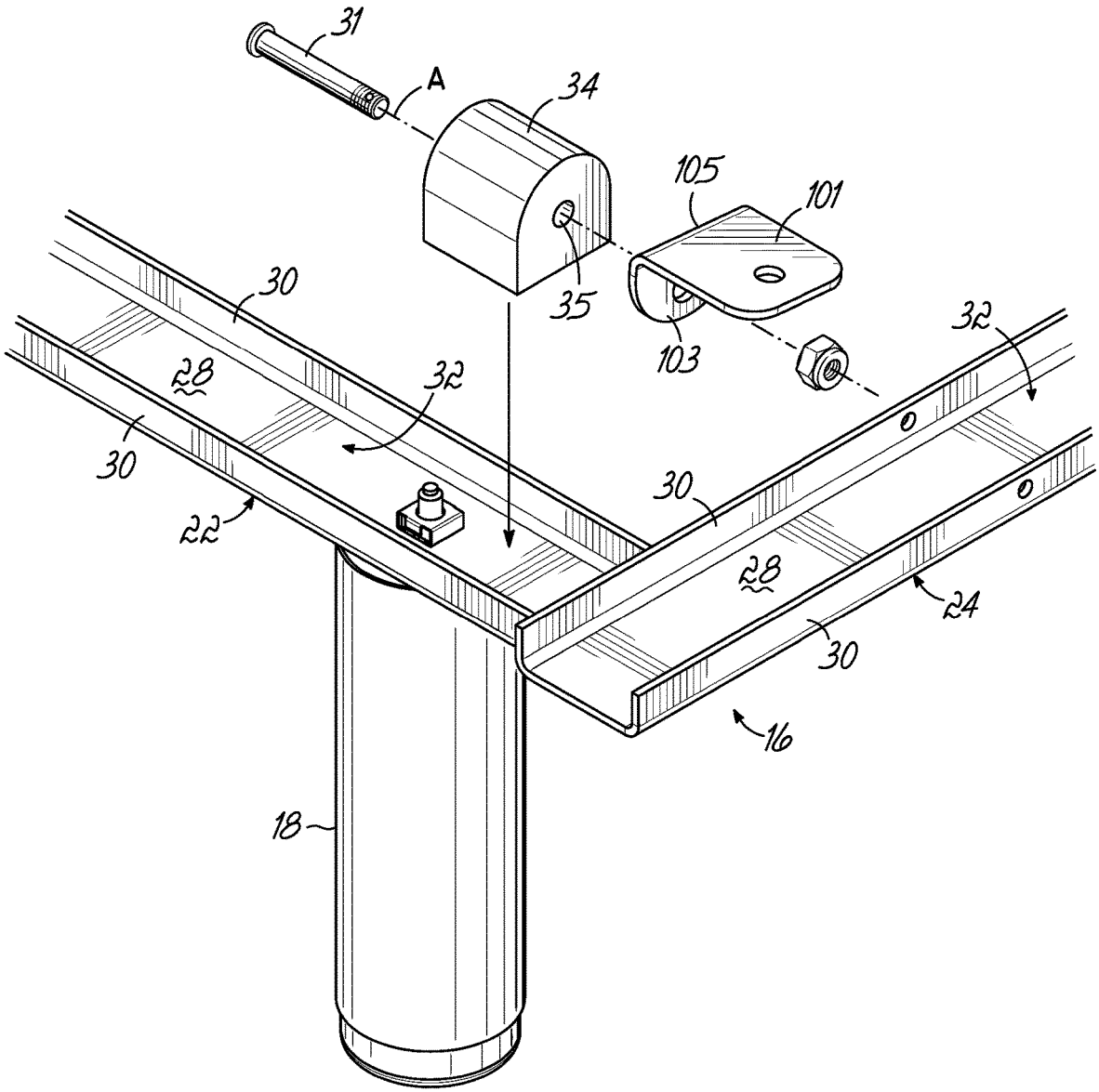
FIG. 5A is an enlarged view of the circled portion 5A of FIG. 5.

As best shown in FIG. 5, the adjustable bed base 12 further comprises two rear spacers 34 secured inside the channel 32 of the foot rail 22 of the stationary frame 16 and two front spacers 33 inside the channel 32 of the head rail 20 of the stationary frame 16. As best seen in FIG. 5A, each of the rear spacers 34 is generally shaped like a cylinder and has an opening 35 extending through the spacer 34. The opening 35 is adapted to allow a threaded fastener 31 to pass through the opening 35. The rear spacers 34 are preferably made of metal but may be made of any other material. Although each of the front spacers 33 is block shaped, it may be any desired shape.

Figure 4:
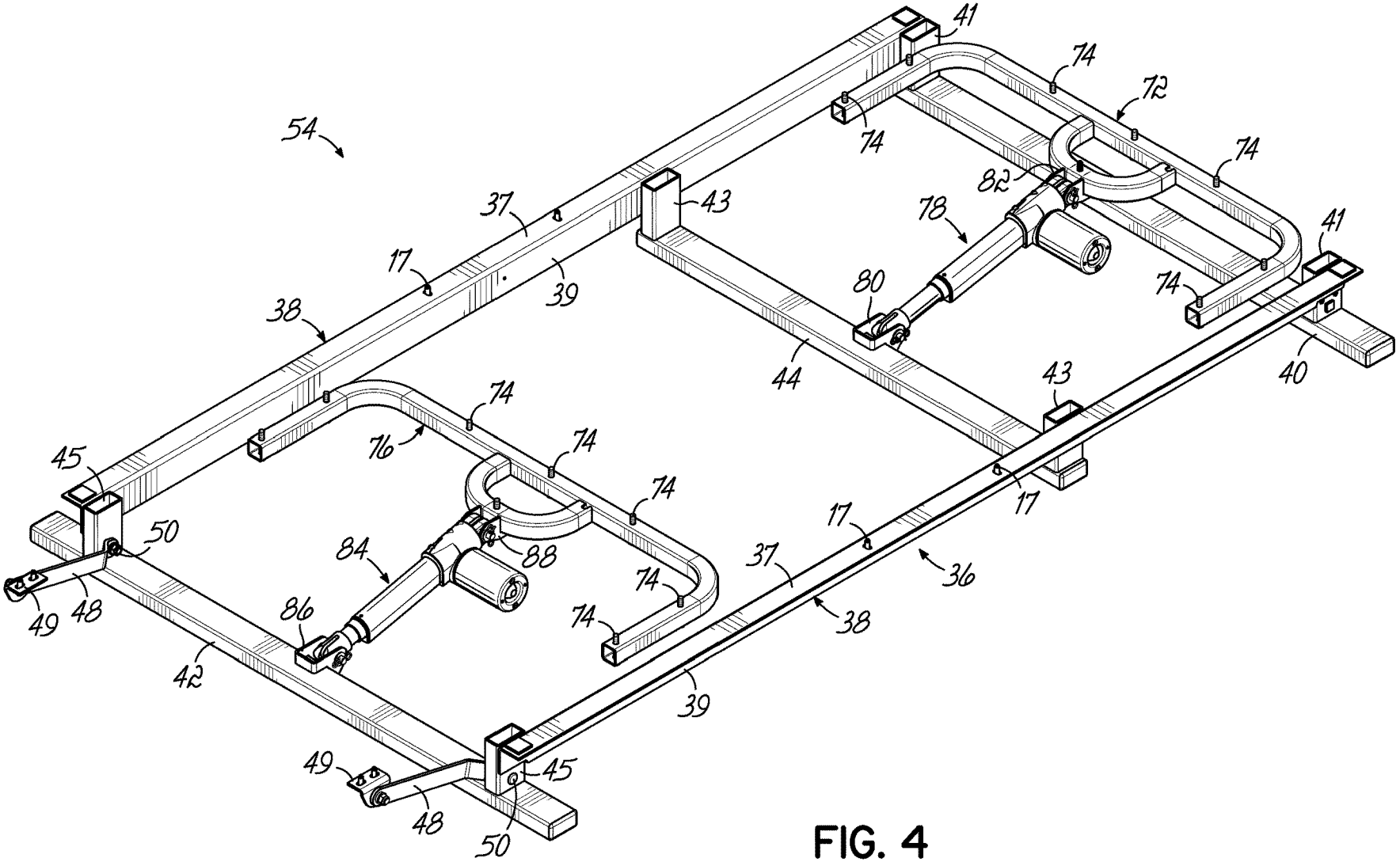
FIG. 4 is a perspective view of a portion of the subframe assembly.

As best shown in FIG. 4, the adjustable bed base 12 further comprises a subframe 36 comprising opposed side members 38, a front member 40, a rear member 42 and a cross member 44. Although FIG. 4 shows each of the opposed side members 38 being an angled metal member having an L-shaped cross section including a horizontal flange 37 and a vertical flange 39, one or more of these side members 38 may be shaped differently than as shown. As best shown in FIG. 4, the front member 40 is spaced below the side members 38 with stubs 41 welded to the side members 38 and front member 40. Similarly, the cross member 44 is spaced below the side members 38 with stubs 43 welded to the side members 38 and cross member 44. Lastly, the rear member 42 is spaced below the side members 38 with stubs 45 welded to the side members 38 and rear member 42. Although each of the stubs 41, 43 and 45 is illustrated being a hollow member, some of the stubs may be solid members or shapes other than those shown in the drawings.

As best shown in FIG. 4, the subframe 36 also includes two foot links 48. As shown in FIG. 4, each of the foot links 48 is pivotal about a horizontal axis defined by a fastener 50, the fastener 50 extending through one of the stubs 45 secured to the rear member 42 of the subframe 36. The other end of each of the foot links 48 is pivotally secured to a mounting bracket 49 secured to the foot deck board 68 described below.

Figure 3:
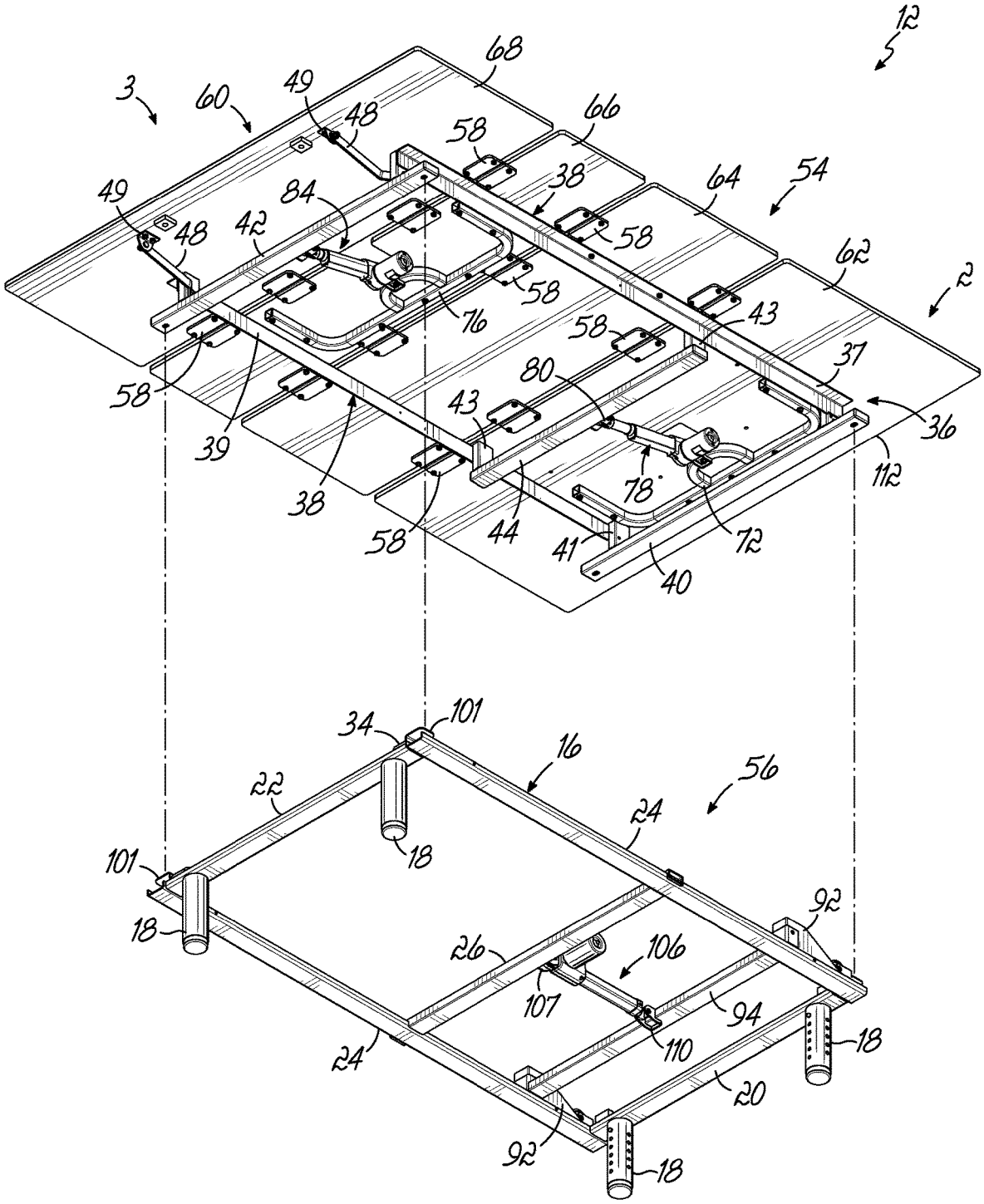
FIG. 3 is a bottom perspective view of a subframe assembly of the adjustable bed base separated from a frame assembly of the adjustable bed base.

As best shown in FIG. 3, the subframe 36 is part of a subframe assembly 54 for purposes of this document. Although not shown in FIG. 4, the deck 60 is part of the subframe assembly 54. Although shown in FIG. 4, wheel mounting brackets and rotatable wheels are part of the subframe assembly 54 for purposes of this document. FIG. 4 shows an enlarged view of the subframe assembly 54 without the articulated deck. FIG. 5 shows an enlarged view of the frame assembly 56.

As best shown in FIGS. 1 and 2, the adjustable bed base 12 further comprises an articulating deck 60 comprising a head deck board 62 hinged to a seat deck board 64 with hinges 58. As best shown in FIG. 2, the seat deck board 64 is secured to the side members 38 of the subframe 36 with fasteners 17 and does not move when the deck 60 is articulated. See FIGS. 6A-6D. A leg deck board 66 is hinged to the seat deck board 64 with hinges 58. Lastly, a foot deck board 68 is hinged to the leg deck board 66 with hinges 58. Although four hinges 58 are shown securing adjacent deck boards, any other number of hinges may be used.

As best shown in FIG. 1, a stop 70 is secured to the foot deck board 68 of the deck 60 and functions to prevent movement of the mattress 5 relative to the adjustable bed base 12 when the deck 60 is articulated.

As best shown in FIGS. 3 and 4, the subframe assembly 54 of the adjustable bed base 12 further comprises a generally U-shaped head brace 72 secured to the underside of the head deck board 62 with fasteners 74. The subframe assembly 54 of the adjustable bed base 12 further comprises a generally U-shaped leg brace 76 secured to the underside of the leg deck board 66 with fasteners 74. As best shown in FIG. 4, although each of the head and leg braces 72, 76 respectively, is shown as comprising multiple pieces of hollow metal, either of the head and leg braces 72, 76 respectively, may be made of any number of pieces of any known material. The generally U-shaped head brace 72 functions to strengthen the head deck board 62 and provide an anchor for the linear actuator described below. Similarly, the generally U-shaped leg brace 76 functions to strengthen the leg deck board 66 and provide an anchor for the other linear actuator described below.

Although the head brace 72 and leg brace 76 are illustrated being a certain shape, they may be any other shape. The drawings are not intended to limit the size or shape of either the head brace 72 or leg brace 76.

As best shown in FIG. 4, the subframe assembly 54 of the adjustable bed base 12 further comprises a motorized front secondary linear actuator 78 for inclining the head deck board 62. The motorized front secondary linear actuator 78 has a rear or first end pivotally secured to a mounting bracket 80 secured to the cross member 44 of the subframe 36. The motorized front secondary linear actuator 78 has a front or second end pivotally secured to a mounting portion 82 of the generally U-shaped head brace 72. Although the mounting portion 82 is shown as two spaced ears, it may be any other desired shape. Again, the drawings are not intended to be limiting.

As best shown in FIG. 4, the subframe assembly 54 of the adjustable bed base 12 further comprises a motorized rear secondary linear actuator 84 for inclining the leg deck board 66, which in turn inclines the foot deck board 68. The motorized rear secondary linear actuator 84 has a rear or first end pivotally secured to a mounting bracket 86 secured to the rear member 42 of the subframe 36. The motorized rear secondary linear actuator 84 has a front or second end pivotally secured to a mounting portion 88 of the generally U-shaped leg brace 76. Although the mounting portion 88 is shown as two spaced ears, it may be any other desired shape. Again, the drawings are not intended to be limiting.

Although not shown, either end of either the front or rear secondary linear actuator 78, 84 may be secured to a mounting bracket. For example, the front or second end of motorized front secondary linear actuator 78 may be secured to a mounting bracket secured to the generally U-shaped head brace 72, rather than being secured to a mounting portion 82 of the generally U-shaped head brace 72.

Likewise, the front or second end of motorized rear secondary linear actuator 84 may be secured to a mounting bracket secured to the generally U-shaped leg brace 76, rather than being secured to a mounting portion 88 of the generally U-shaped leg brace 76.

Referring to FIG. 5, the frame assembly 56 includes the stationary frame 16 described above. As best seen in FIG. 5, the adjustable bed base 12 further comprises a ramp assembly 90 which is part of the frame assembly 56. The ramp assembly 90 comprises ramps 92 joined by a connector 94. As best shown in FIG. 5, connector 94 includes brackets 96 at the outer ends thereof sized and adapted to receive the ramps 92. Each of the ramps 92 has a groove 98 extending along an inclined surface 100 of the ramp 92. Each of the ramps 92 is sized to be moveable inside one of the channels 32 of one of the side rails 24 of stationary frame 16.

Although shown in FIG. 5, rather than FIG. 4 for ease of understanding, the subframe assembly 54 of the adjustable bed base 12 further comprises wheel mounting brackets 102 secured to the front member 40 of the subframe 36. More particularly, the wheel mounting brackets 102 are secured to the lower surface of the front member 40 of the subframe 36. See FIG. 4. As best shown in FIG. 5, a rotatable wheel 104 is secured to each of the wheel mounting brackets 102. Each of the rotatable wheels 104 is sized to fit inside the groove 98 of one of the ramps 92 and move therein. The grooves 98 of the ramps 92 guide the movement of the rotational wheels 104 when the motorized primary linear actuator 106 is actuated.

FIG. 5 further shows a pair of pivot brackets 105 at the foot end of the adjustable bed base 12. As best shown in FIG. 5A, each pivot bracket 105 is generally L-shaped and comprises a top portion 101 which is secured to a lower surface of the rear member 42 of the subframe 36. Each pivot bracket 105 further comprises a side portion 103 which is secured to one of the rear spacers 34 with a threaded fastener 31 which extends through opening 35 of the rear spacer 34. The two threaded fasteners 31 (one per spacer 34) are aligned and define a pivot axis A about which the subframe 36 pivots relative to the stationary frame 16.

As best shown in FIG. 5, the frame assembly 56 further comprises a motorized primary linear actuator 106 for raising and lowering the front member 40 of the subframe 36 to pivot the subframe 36 about the pivot axis A defined by fasteners 31. The motorized primary linear actuator 106 has a rear end pivotally secured to a mounting bracket 107. The mounting bracket 107 is secured to the middle rail 26 of the stationary frame 16. The motorized primary linear actuator 106 has a front end pivotally secured to a pin 109 extending between spaced ears 110 extending rearwardly from the connector 100 of the ramp assembly 90. Although not shown a mounting bracket may be used to join a connector of a ramp assembly and the front end of the motorized primary linear actuator 106.

Figure 6A:
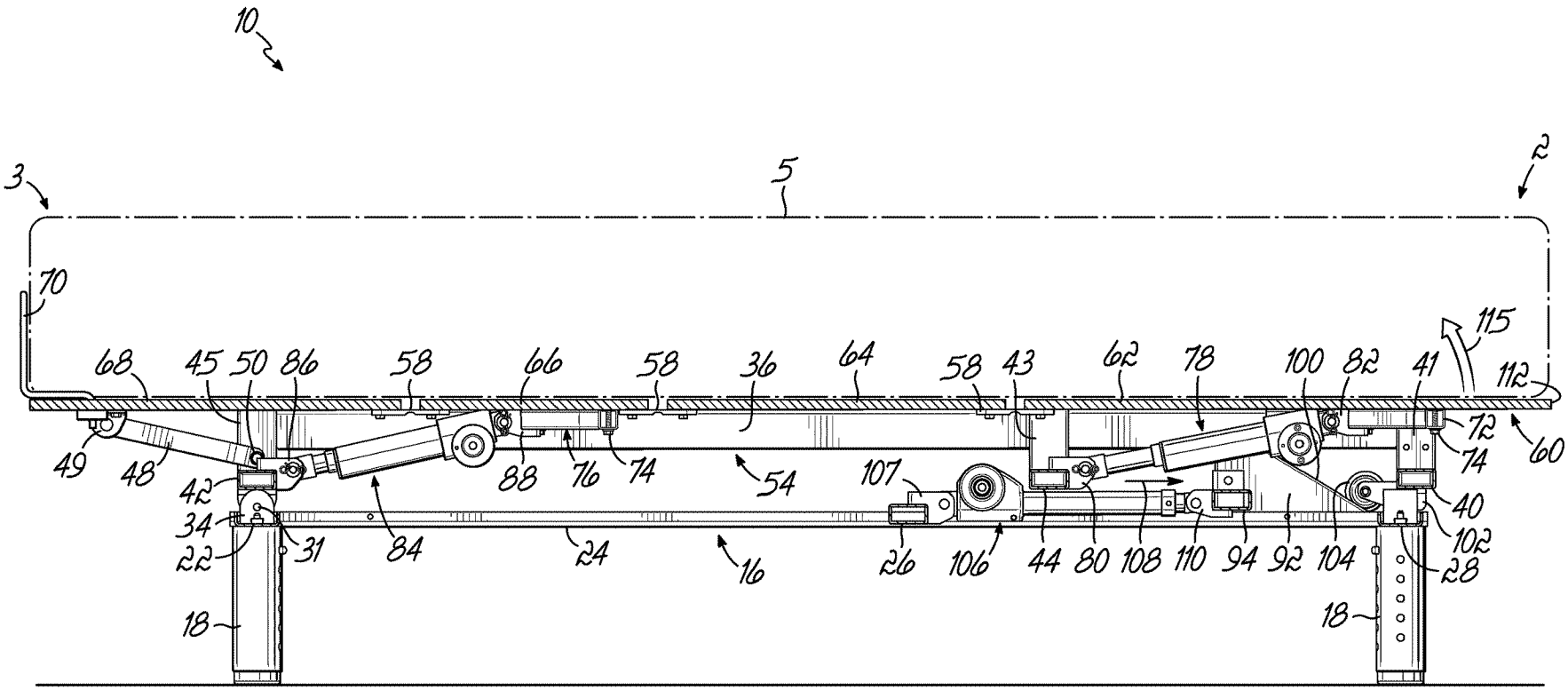
FIG. 6A is a longitudinal cross-sectional view of the adjustable bed base showing the subframe in a lowered position and the deck members co-planar.
Figure 6B:
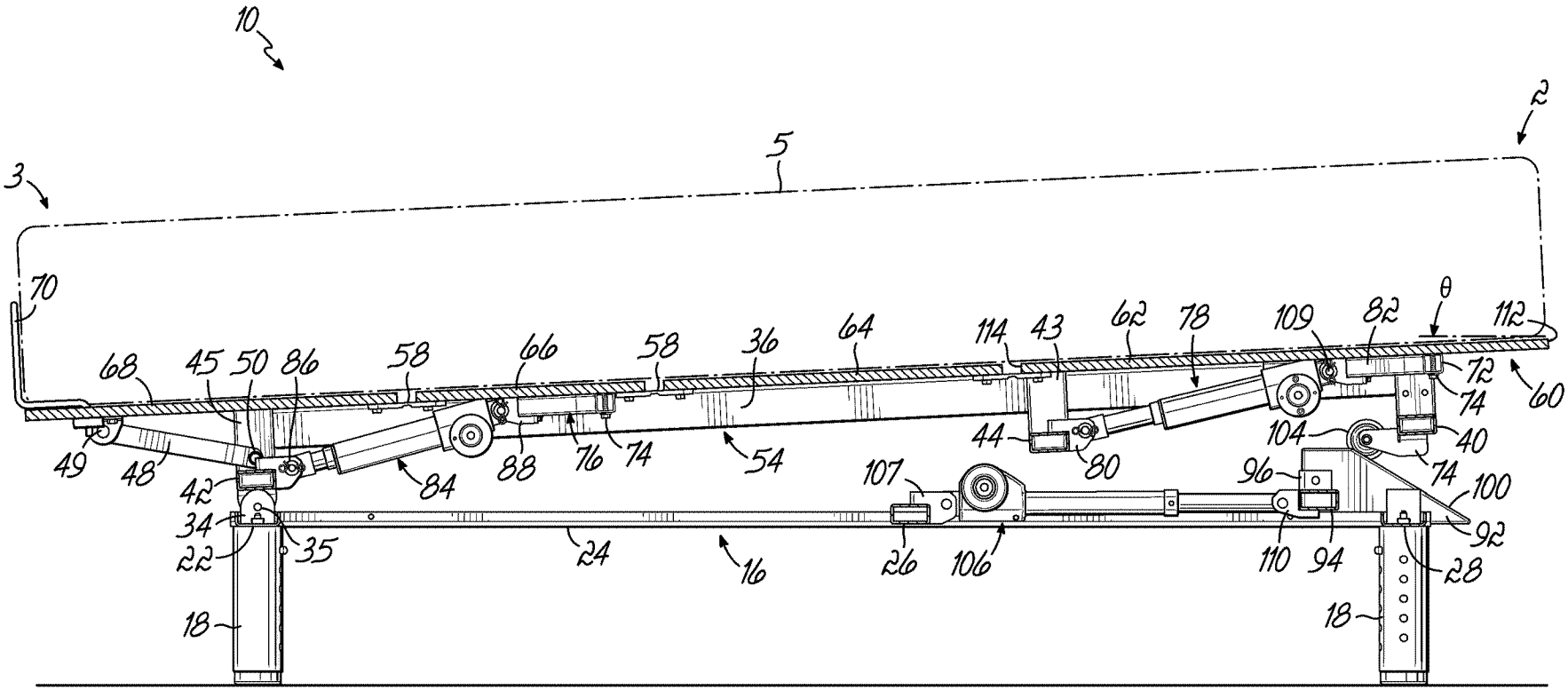
FIG. 6B is a longitudinal cross-sectional view of the adjustable bed base showing the subframe in an inclined position and the deck members co-planar.

FIGS. 6A and 6B show two different positions of the adjustable bed base 12, each with the deck 60 being flat or the deck members being co-planar. FIGS. 6A and 6B also show a method of operation of the adjustable bed base 12. FIG. 6A shows the adjustable bed base 12 in a home position with the subframe 36 is its lowered, horizontal position. In this home position, the motorized primary lift actuator 106 is fully retracted and not activated. From this home position shown in FIG. 6A, the motorized primary linear actuator 106 of adjustable bed base 12 is activated via remote control (not shown) or an app on a phone (not shown) to expand or lengthen. Such expansion of the primary linear actuator 106 shown by arrow 108 in FIG. 6A, moves the ramp assembly 90 forwardly. The forward movement of the connector 94 of the connector assembly 90 by expansion of the primary linear actuator 106 moves the ramps 92 forward in the channels 34 of the side rails 24 of stationary frame 16. This forward movement of the ramps 92 causes the wheels 104 of the subframe 36 to move upwardly inside the grooves 98 of the ramps 92. This upward movement of the wheels 104 raises the front member 40 of subframe 36 in the direction shown by arrow 115 of FIG. 6A to its fully inclined position shown in FIG. 6B. This movement of the wheels 104 causes the front member 40 of subframe 36 to rise upwardly, thereby pivoting the subframe 36 about pivot axis A to its fully inclined position shown in FIG. 6B. FIG. 6B shows the deck 60 in a flat position and the subframe 36 in its fully inclined position due to full extension of the primary lift actuator 106.

FIG. 6B illustrates the deck 60 in a flat position with the deck boards being co-planar. However, the deck 60 is in a tilted or inclined position with a front edge 112 of the head deck board 62 being above a rear edge 114 of the head deck board 62. The same is true for each of the deck boards. In the industry this is known as a Reverse Trendelenburg position. When the adjustable bed base 12 is in this position shown in FIG. 6B, the subframe 36 and each of the deck boards is inclined at an angle θ which may be up to six degrees relative to horizontal. In this inclined position shown in FIG. 6B, the primary lift actuator 106 is fully extended.

In each of the positions shown in FIGS. 6A and 6B, the front and rear secondary linear actuators 78, 84, respectively, are in their retracted position and are not activated, thereby resulting in a flat deck 60.

Figure 6C:
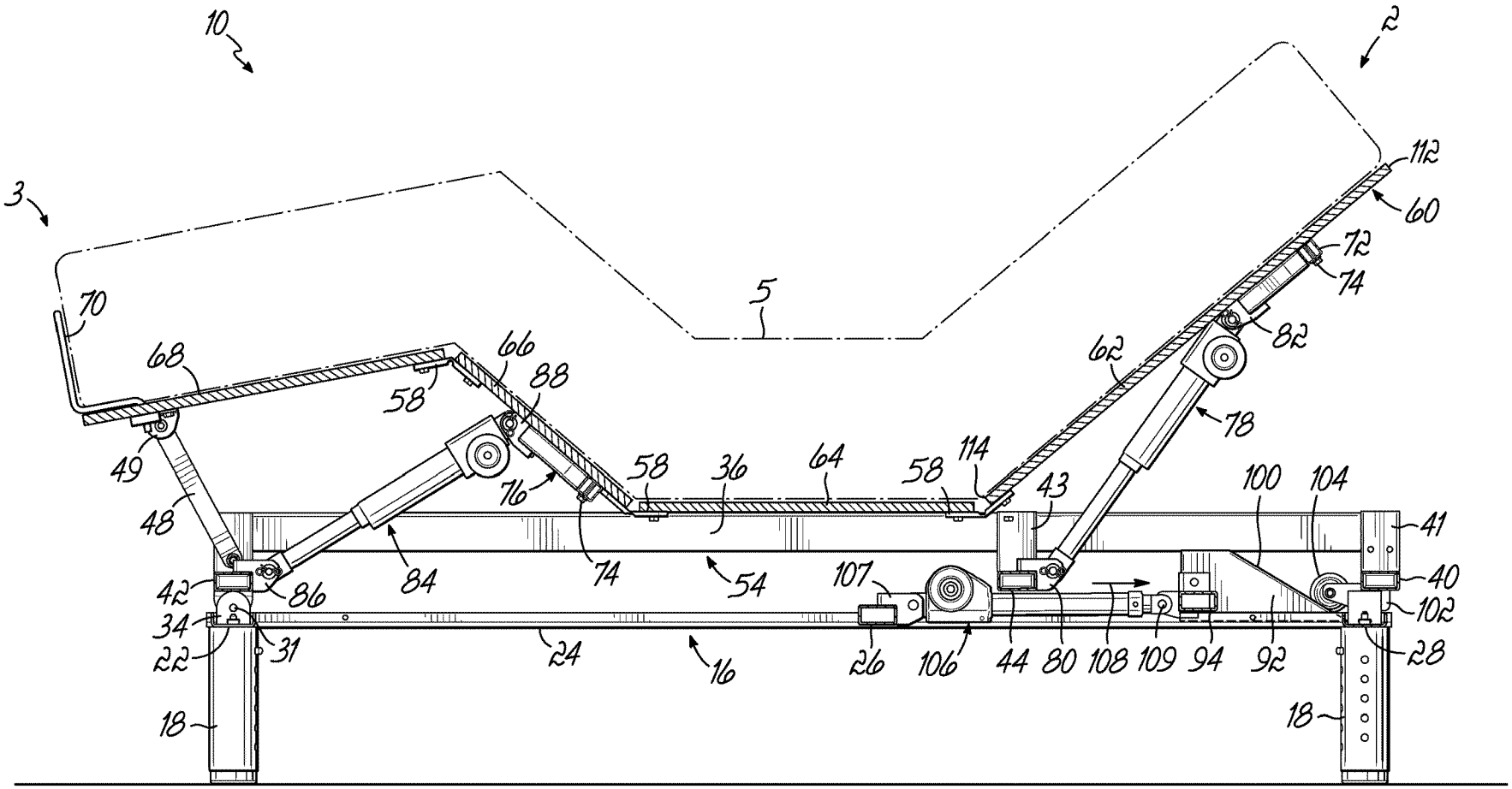
FIG. 6C is a longitudinal cross-sectional view of the adjustable bed base showing the subframe in a lowered position and the deck members fully inclined.
Figure 6D:
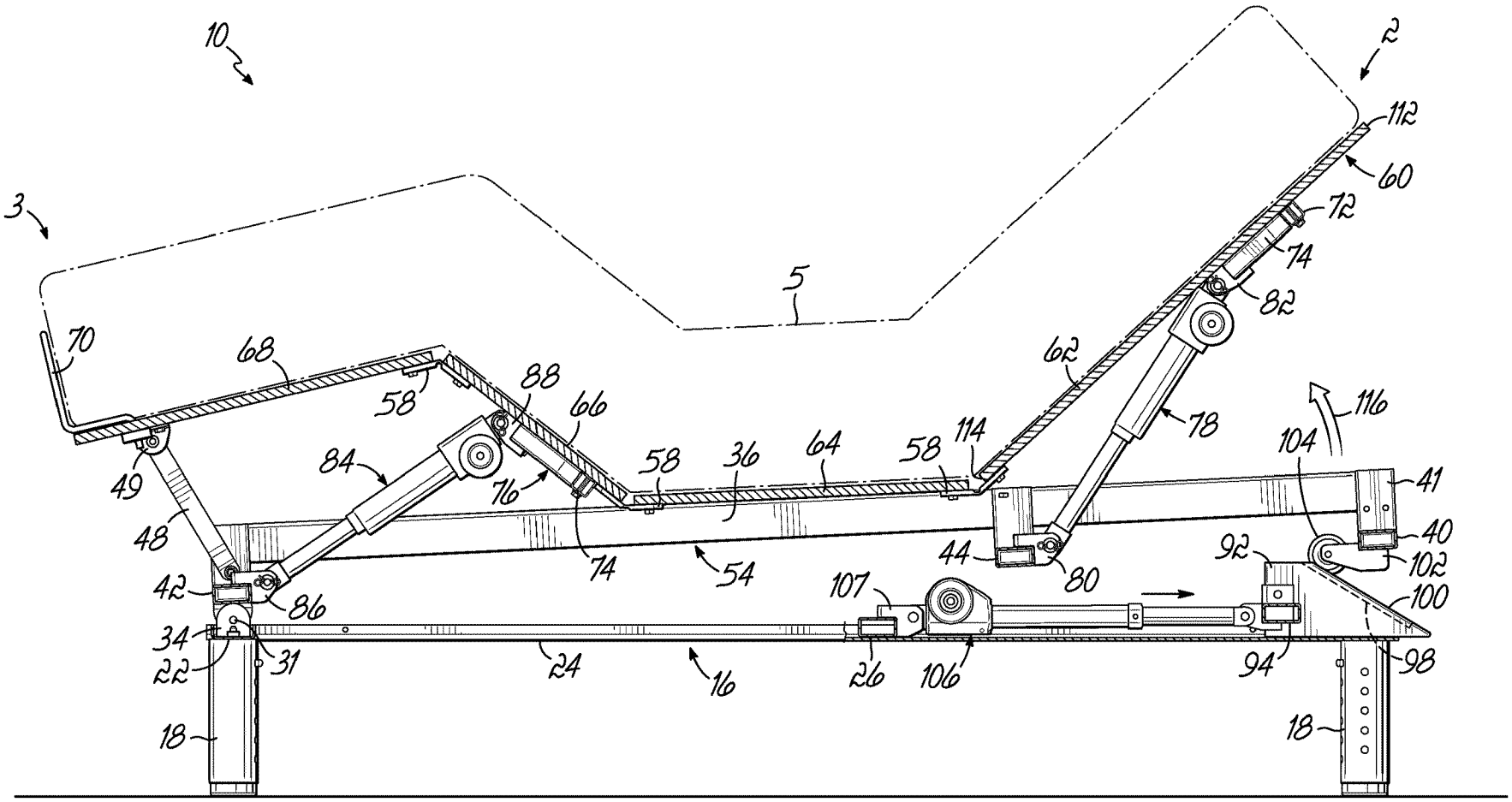
FIG. 6D is a longitudinal cross-sectional view of the adjustable bed base showing the subframe in an inclined position and the deck members fully inclined.

FIGS. 6C and 6D correspond to FIGS. 6A and 6B with the subframe 36 in the same respective positions. However, the deck 60 is shown in FIGS. 6C and 6D fully inclined or articulated. In other words, the front and rear secondary linear actuators 78, 84, respectively, are fully extended in FIGS. 6C and 6D. However, In FIG. 6C, the primary lift actuator 106 is not activated and fully retracted. In FIG. 6D, the primary lift actuator 106 is activated and fully extended.

FIG. 6C shows the adjustable bed base 12 in a home position with the subframe 36 is its lowered position like FIG. 6A. In this home position, the primary lift actuator 106 is fully retracted. From this home position shown in FIG. 6C, the primary linear actuator 106 of adjustable bed base 12 is activated via remote control (not shown) or phone app (not shown) to expand or lengthen. Such expansion of the primary linear actuator 106 shown by arrow 108 in FIG. 6C, causes movement of the ramps 92 forwardly, moving the wheels 104 in grooves 98 upwardly. This movement of the wheels 104 causes the front member 40 of subframe 36 to move upwardly, thereby pivoting the subframe 36 to its fully inclined position shown in FIGS. 6B and 6D.

FIG. 6C illustrates the articulated deck 60 in a fully inclined position with the head, leg and foot deck boards 62, 66, 68 being fully inclined due to full extension of the front and rear secondary lift actuators 78, 84, respectively. However, the articulated deck 60 is in a first tilted position with the front edge 112 of the head deck board 62 being above the rear edge 114 of the head deck board 62. When the adjustable bed base 12 is in the position shown in FIG. 6D, the subframe 36 is inclined with the motorized primary linear actuator 106 fully extended. In this inclined position shown in FIG. 6D, the front and rear secondary lift actuators 78, 84, respectively, are too fully extended.

Although not shown, regardless of whether the subframe 36 is inclined or horizontal, only one, rather than both, of the front and rear secondary lift actuators 78, 84, respectively, may be partially or fully extended, thereby moving the deck boards to desired positions.

Referring to FIGS. 7-13C, another embodiment of adjustable bed 10*a* includes an adjustable bed base 12*a* for supporting a mattress 5. The adjustable bed base 12*a* has a head end 2 and a foot end 3. The adjustable bed base 12*a* of the present invention may be used with any type of mattress. The mattress is not intended to be limited by the drawings. For the sake of simplicity, like numbers refer to like parts.

Figure 8:
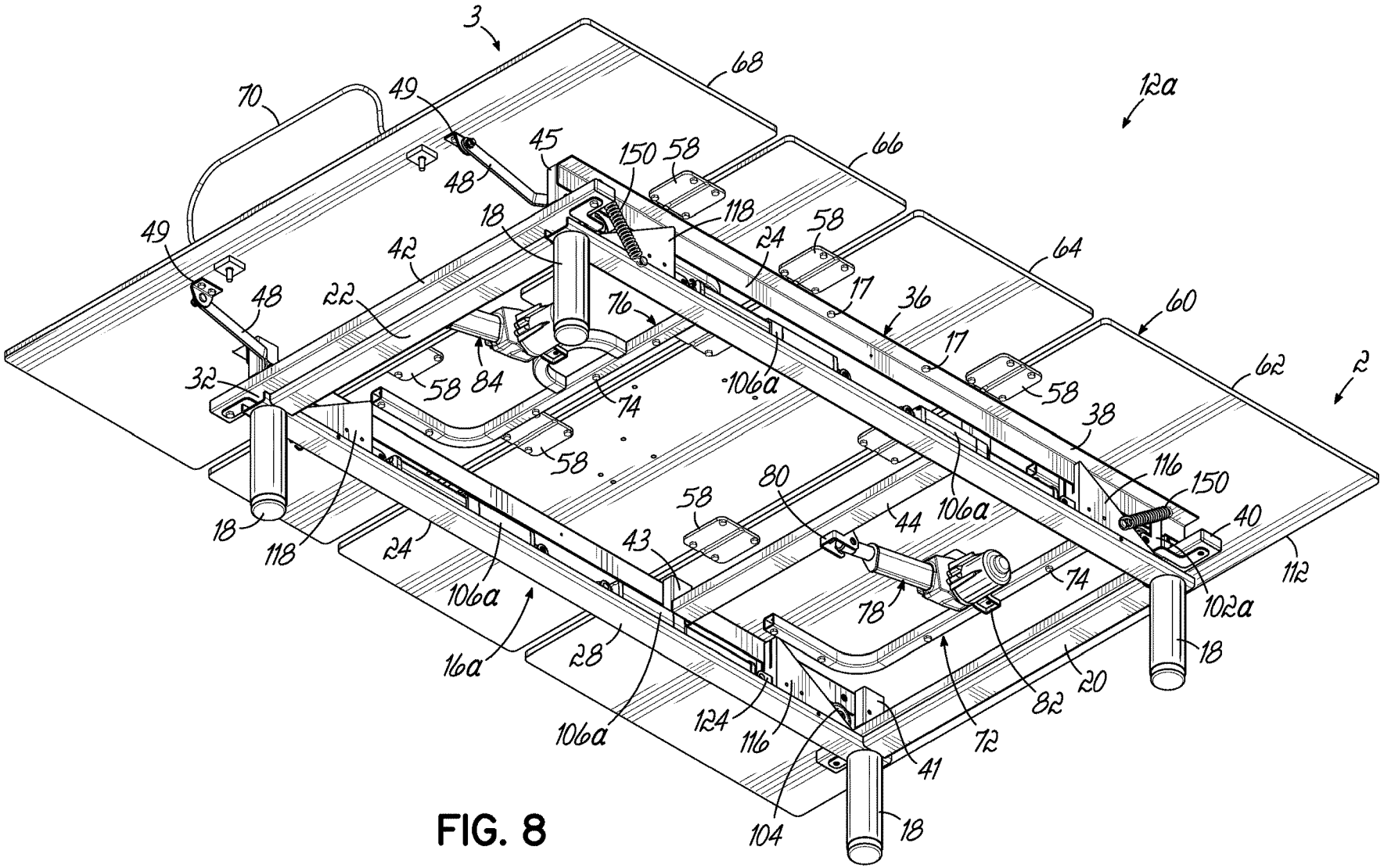
FIG. 8 is a bottom perspective view of the adjustable bed base of FIG. 7.

As best shown in FIG. 8, the adjustable bed base 12*a* comprises a generally rectangular stationary frame 16 supported by leg assemblies or legs 18. The leg assemblies 18 are illustrated as being adjustable in height. Although one type of leg assembly 18 is illustrated supporting the adjustable bed base 12*a*, any other type of leg assembly including unitary legs not adjustable in height may be used in accordance with the present invention. The legs of the adjustable bed base are not intended to be limited by the drawings.

Figure 11:
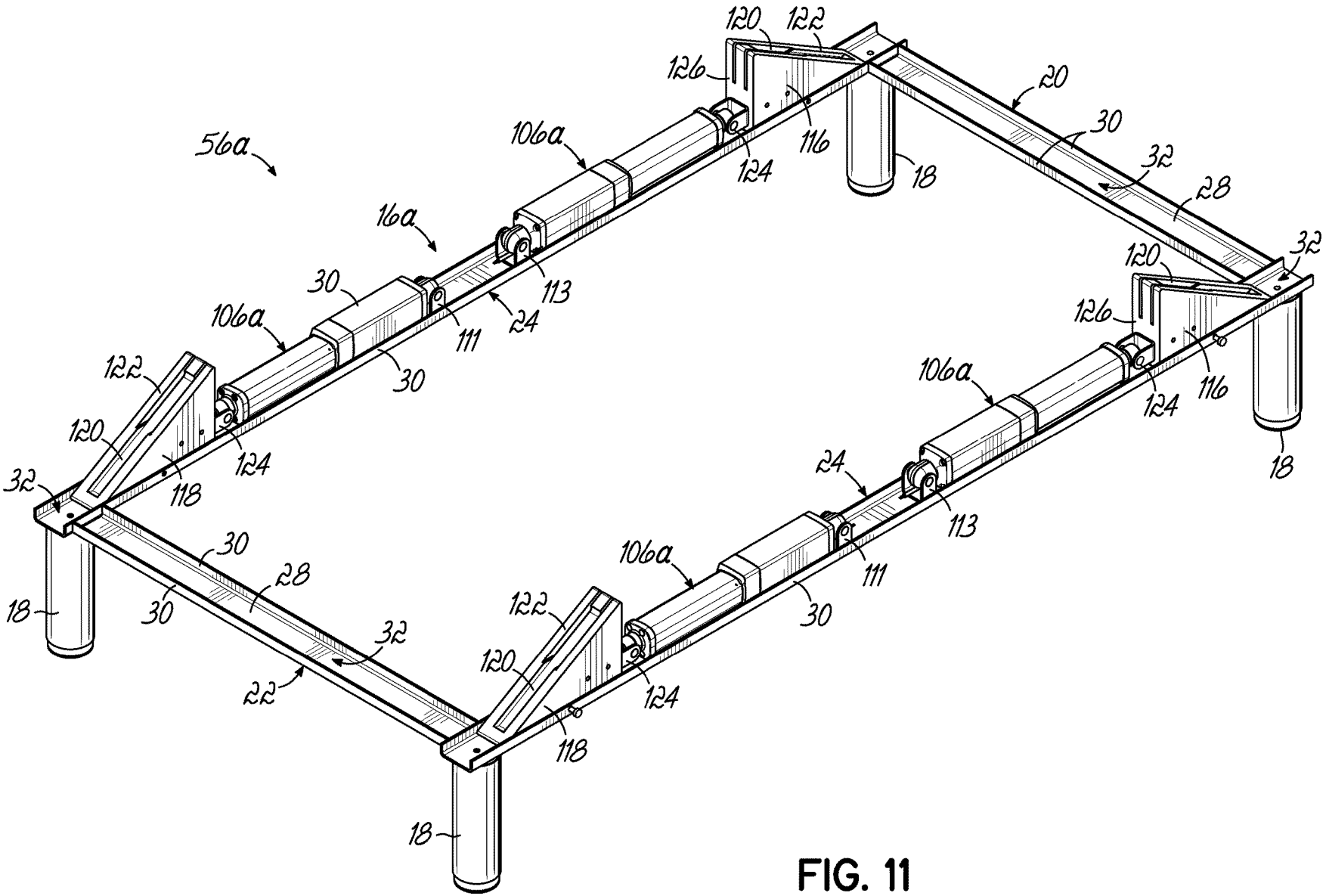
FIG. 11 is a perspective view of a portion of the frame assembly.

As best shown in FIG. 11, the generally rectangular stationary frame 16*a* comprises a head rail 20, a foot rail 22 and two opposed side rails 24. The head rail 20 and foot rails 22 each extend between the opposed side rails 24. As best shown in FIG. 11, each of the side rails 24, the head rail 20 and foot rail 22 each have a C-shaped cross section comprising a bottom wall 28 and two side walls 30 extending upwardly from the bottom wall 28 which define a channel 32.

As best shown in FIG. 11, the adjustable bed base 12*a* further comprises a front anchor 113 and a rear anchor 111 secured to each of the side rails 24 of the stationary frame 16*a*. As best shown in FIG. 11, the front anchor 113 and rear anchor 111 are located generally inside the channel 32 of the side rail 24 of the stationary frame 16*a*. Each of the front and rear anchors 113, 111 is preferably made of metal but may be made of any other material. Although each of the front and rear anchors 113, 111 is generally U-shaped, either may be any desired shape or size. The drawings are not intended to be limiting.

Figure 10:
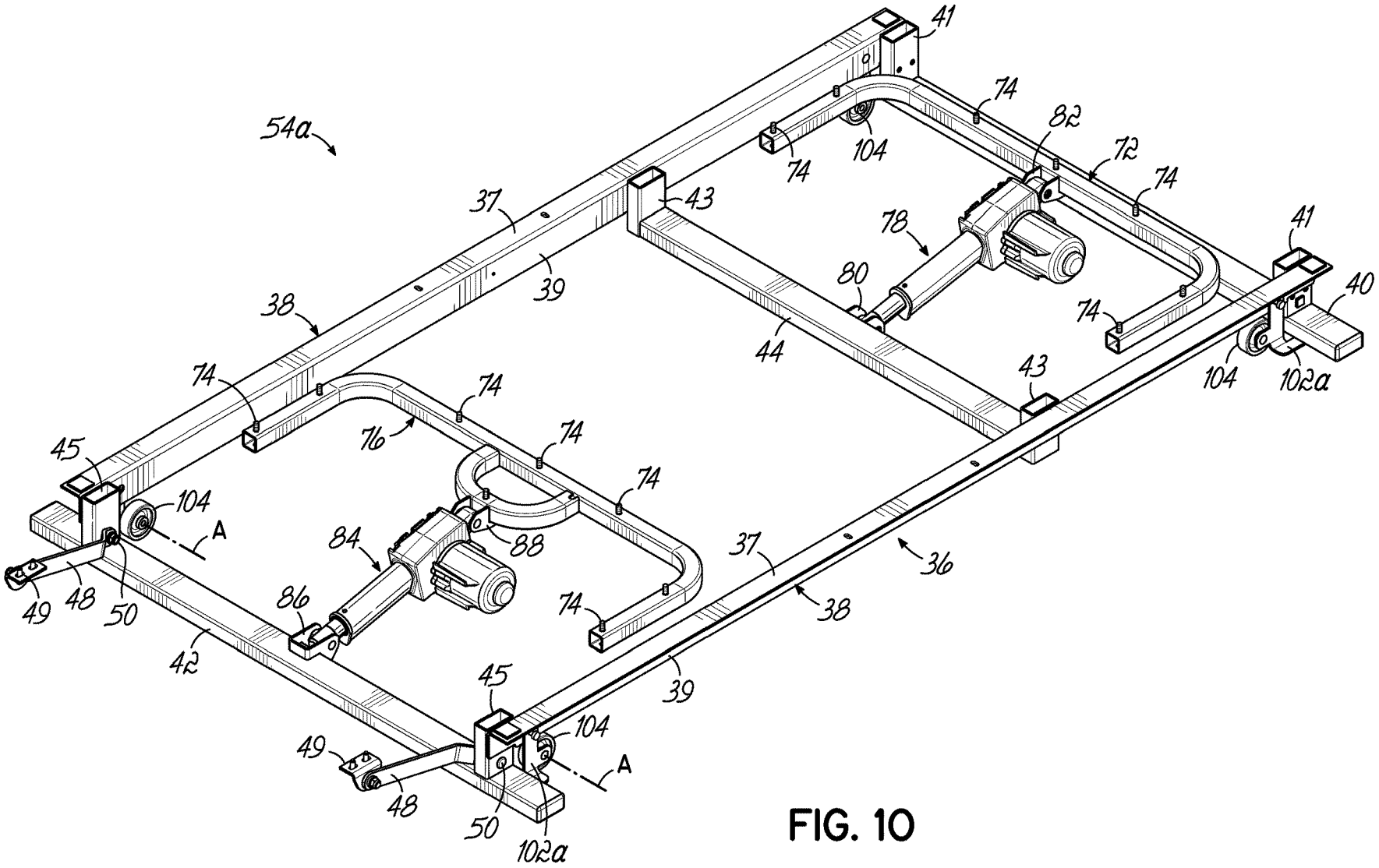
FIG. 10 is a perspective view of a portion of the subframe assembly.

As best shown in FIG. 10, the adjustable bed base 12*a* further comprises a subframe 36 comprising opposed side members 38, a front member 40, a rear member 42 and a cross member 44. Although FIG. 10 shows each of the opposed side members 38 being an angled metal member having an L-shaped cross section including a horizontal flange 37 and a vertical flange 39, one or more of these side members 38 may be shaped differently than as shown. As best shown in FIG. 10, the front member 40 is spaced below the side members 38 with stubs 41 welded to the side members 38 and front member 40. Similarly, the cross member 44 is spaced below the side members 38 with stubs 43 welded to the side members 38 and cross member 44. Lastly, the rear member 42 is spaced below the side members 38 with stubs 45 welded to the side members 38 and rear member 42. Although each of the stubs 41, 43 and 45 is illustrated being a hollow member, some of the stubs may be solid members or shapes other than those shown in the drawings.

Figure 12A:
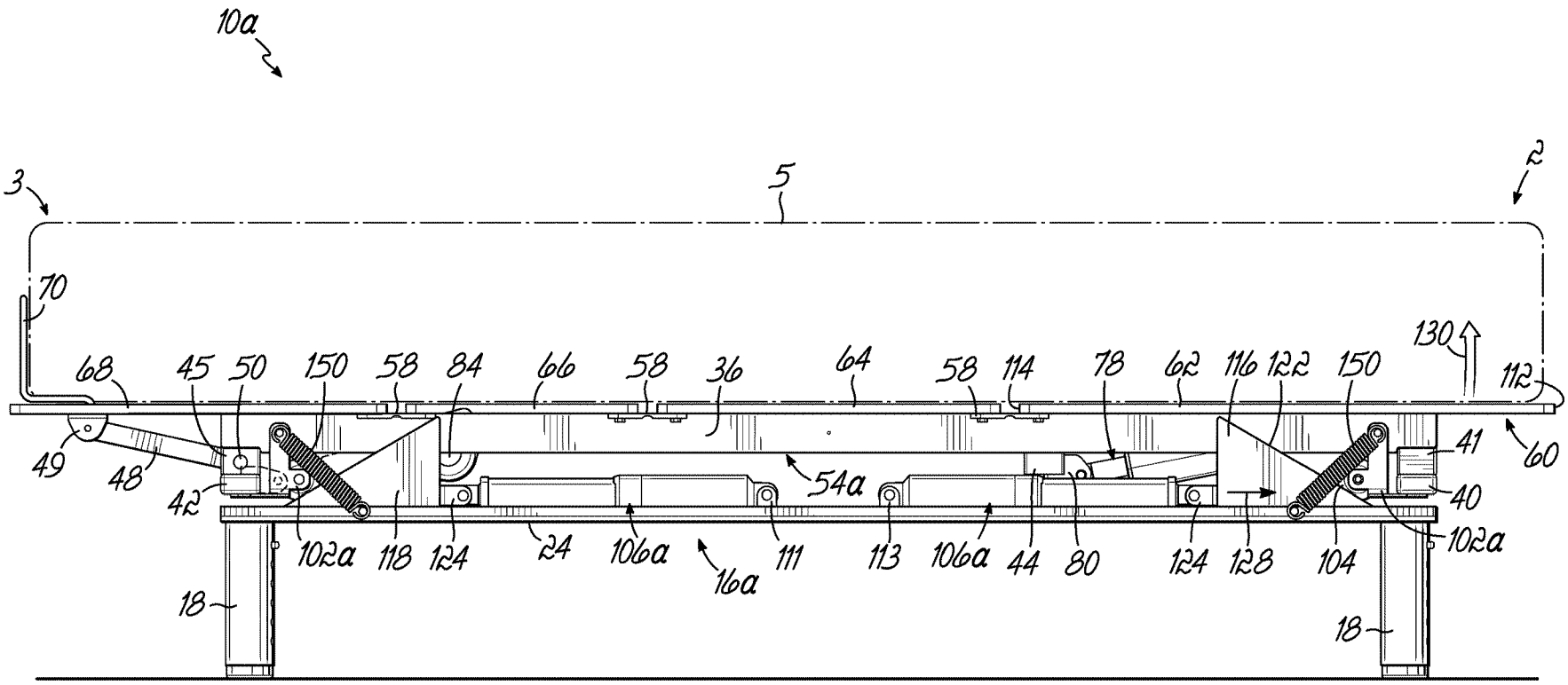
FIG. 12A is a longitudinal cross-sectional view of the adjustable bed base of FIG. 7 showing the subframe in a lowered position and the deck members co-planar.

As shown in FIGS. 8 and 12A, springs 150 extend between the side members 38 of the subframe 36 and the side rails 24 of the stationary frame 16*a*. As best shown in FIG. 12A, two springs 150 are located on each side of the bed base 12*a*.

As best shown in FIG. 10, the subframe 36 also includes foot links 48. As shown in FIG. 10, each of the foot links 48 is pivotal about a horizontal axis defined by a fastener 50, the fastener 50 extending through one of the stubs 45 secured to the rear member 42 of the subframe 36. The other end of each of the foot links 48 is pivotally secured to a mounting bracket 49 secured to the foot deck board 68 described below.

Figure 9:
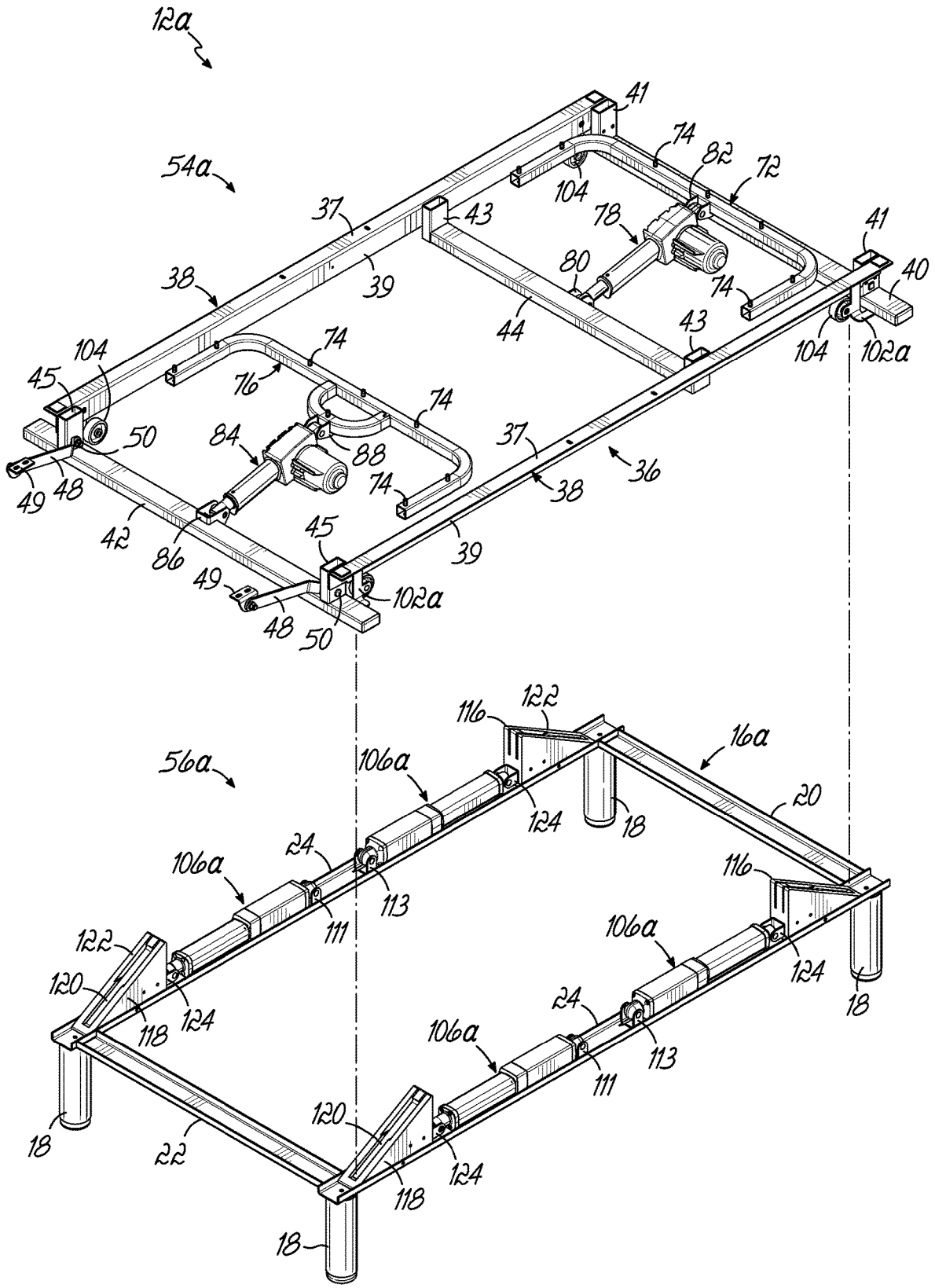
FIG. 9 is a bottom perspective view of a subframe assembly of the adjustable bed base of FIG. 7 separated from a frame assembly of the adjustable bed base of FIG. 7.

As best shown in FIG. 9, the subframe 36 is part of a subframe assembly 54*a* for purposes of this document. Although not shown in FIG. 10, the deck 60 is part of the subframe assembly 54*a*. As shown in FIG. 10, wheel mounting brackets and rotatable wheels are part of the subframe assembly 54*a* for purposes of this document. FIG. 10 shows an enlarged view of the subframe assembly 54*a* without the articulated deck. FIG. 11 shows an enlarged view of the frame assembly 56*a*.

Figure 7:
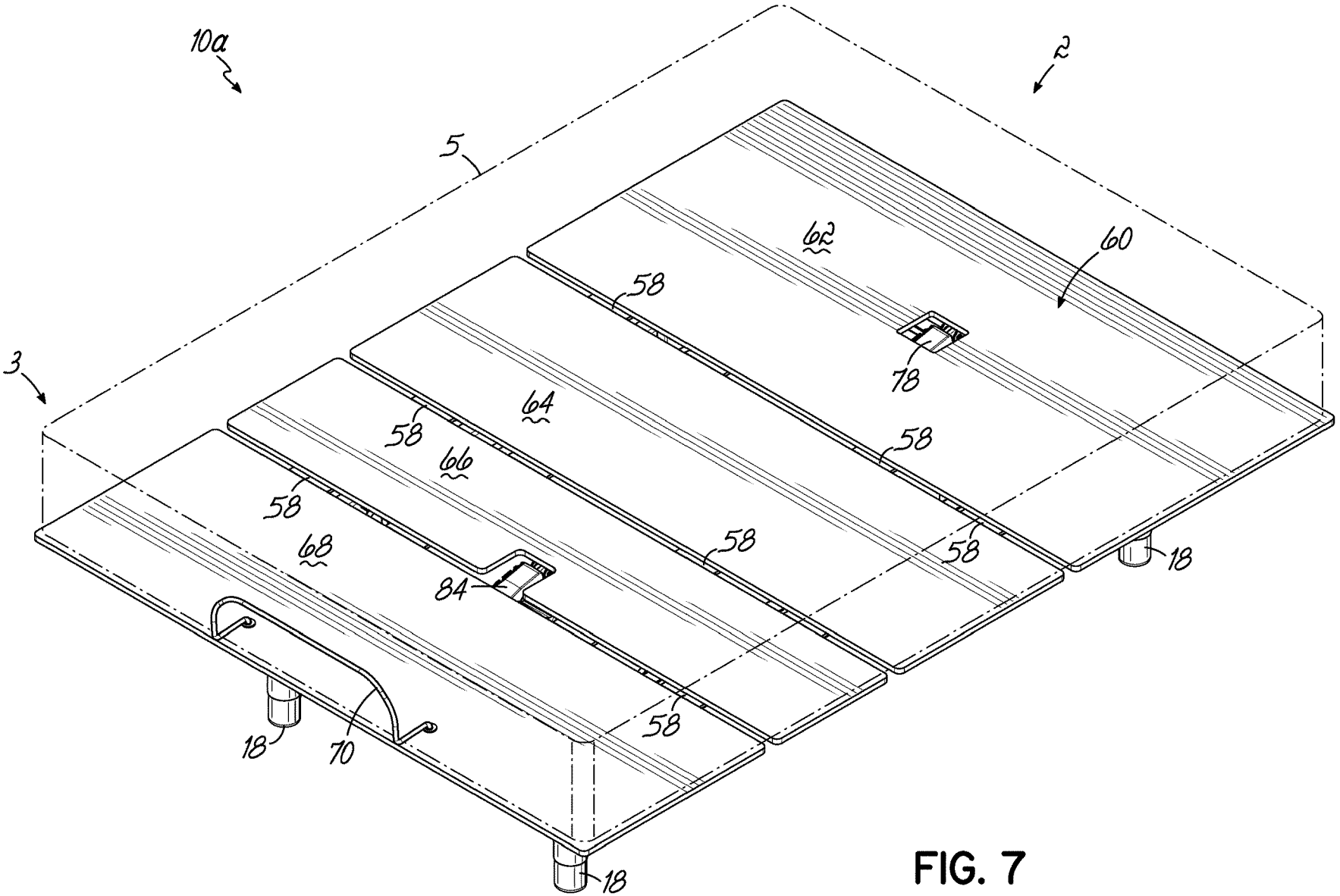
FIG. 7 is a top perspective view of another embodiment of adjustable bed base.

As best shown in FIGS. 7 and 8, the adjustable bed base 12*a* further comprises an articulating deck 60 comprising a head deck board 62 hinged to a seat deck board 64 with hinges 58. As best shown in FIG. 8, the seat deck board 64 is secured to the side members 38 of the generally rectangular subframe 36 with fasteners 17 and does not move when the deck 60 is articulated. See FIGS. 13A-13C. A leg deck board 66 is hinged to the seat deck board 64 with hinges 58. Lastly, a foot deck board 68 is hinged to the leg deck board 66 with hinges 58. Although three hinges 58 are shown securing adjacent deck boards, any other number of hinges may be used.

As best shown in FIG. 1, a stop 70 is secured to the foot deck board 68 of the deck 60 and functions to prevent movement of the mattress 5 relative to the adjustable bed base 12*a* when the deck 60 is articulated.

As best shown in FIGS. 9 and 10, the subframe assembly 54*a* of the adjustable bed base 12*a* further comprises a generally U-shaped head brace 72 secured to the underside of the head deck board 62 with fasteners 74. The subframe assembly 54*a* of the adjustable bed base 12*a* further comprises a generally U-shaped leg brace 76 secured to the underside of the leg deck board 66 with fasteners 74. As best shown in FIG. 10, although each of the head and leg braces 72, 76 respectively, is shown as comprising multiple pieces of hollow metal, either of the head and leg braces 72, 76 respectively, may be made of any number of pieces of any known material. The generally U-shaped head brace 72 functions to strengthen the head deck board 62 and provide an anchor for the linear actuator 78 described below. Similarly, the generally U-shaped leg brace 76 functions to strengthen the leg deck board 66 and provide an anchor for the other linear actuator 84 described below.

Although the head brace 72 and leg brace 76 are illustrated being a certain shape, they may be any other shape. The drawings are not intended to limit the size or shape of either the head brace 72 or leg brace 76.

As best shown in FIG. 10, the subframe assembly 54*a* of the adjustable bed base 12*a* further comprises a motorized front secondary linear actuator 78 for inclining the head deck board 62. The motorized front secondary linear actuator 78 has a rear or first end pivotally secured to a mounting bracket 80 secured to the cross member 44 of the subframe 36. The motorized front secondary linear actuator 78 has a front or second end pivotally secured to a mounting portion 82 of the generally U-shaped head brace 72. Although the mounting portion 82 is shown as two spaced ears, it may be any other desired shape. Again, the drawings are not intended to be limiting.

As best shown in FIG. 10, the subframe assembly 54*a* of the adjustable bed base 12*a* further comprises a motorized rear secondary linear actuator 84 for inclining the leg deck board 66, which in turn inclines the foot deck board 68. The motorized rear secondary linear actuator 84 has a rear or first end pivotally secured to a mounting bracket 86 secured to the rear member 42 of the subframe 36. The motorized rear secondary linear actuator 84 has a front or second end pivotally secured to a mounting portion 88 of the generally U-shaped leg brace 76. Although the mounting portion 88 is shown as two spaced ears, it may be any other desired shape. Again, the drawings are not intended to be limiting.

Although not shown, either end of either the front or rear secondary linear actuator 78, 84 may be secured to a mounting bracket. For example, the front or second end of motorized front secondary linear actuator 78 may be secured to a mounting bracket secured to the generally U-shaped head brace 72, rather than being secured to a mounting portion 82 of the generally U-shaped head brace 72.

Likewise, the front or second end of motorized rear secondary linear actuator 84 may be secured to a mounting bracket secured to the generally U-shaped leg brace 76, rather than being secured to a mounting portion 88 of the generally U-shaped leg brace 76.

Referring to FIG. 11, the frame assembly 56*a* includes the stationary frame 16*a* described above. As best seen in FIG. 10, the frame assembly 56*a* further comprises two front ramps 116 and two rear ramps 118. Each of the front and rear ramps 116, 118 has a groove 120 extending along an inclined surface 122 of the ramp. Each of the front and rear ramps 116, 118 is sized to be moveable inside one of the channels 32 of one of the side rails 24 of stationary frame 16*a*. Each of the front and rear ramps 116, 118 has a mounting bracket 124 attached to a vertical surface 126 thereof.

As shown in FIG. 10, the subframe assembly 54*a* of the adjustable bed base 12*a* further comprises wheel mounting brackets 102*a* secured to the front member 40 of the subframe 36. More particularly, the wheel mounting brackets 102*a* are secured to the lower surface of the front member 40 of the subframe 36. See FIG. 10. As best shown in FIG. 10, a rotatable wheel 104 is secured to each of the wheel mounting brackets 102*a*. Each of the rotatable wheels 104 is sized to fit inside the groove 120 of one of the front and rear ramps 116, 118 and move therein. The grooves 120 of the front and rear ramps 116, 118 guide the movement of the rotational wheels 104 when two of the motorized primary linear actuators 106*a* is actuated.

As best shown in FIG. 11, the frame assembly 56*a* further comprises four motorized primary linear actuators 106*a*, each motorized primary linear actuator 106*a* being in one of the channels 32 of one of the side rails 24 of stationary frame 16. The two front motorized primary linear actuators 106*a* move the front ramps 116 forward and backward in the channels 32 of the side rails 24 to raise and lower the front member 40 of the subframe 36. Such movement of the front ramps 116 causes the subframe 36 to pivot about a pivot axis A shown in FIG. 10. Each motorized primary linear actuator 106*a* has an end pivotally secured to a mounting bracket 124 secured to one of the front and rear ramps 116, 118 and a second end pivotally secured to one of the anchors 113, 111.

Figure 12B:
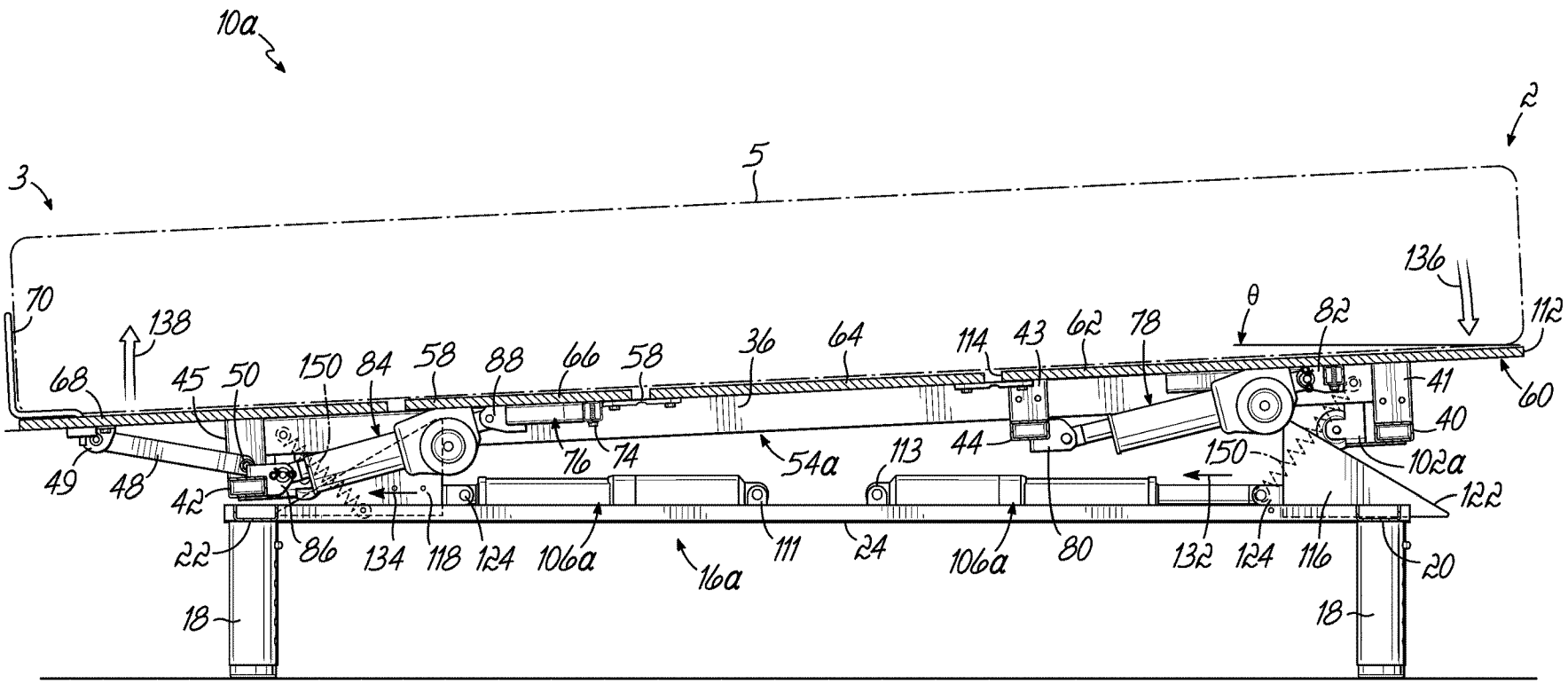
FIG. 12B is a longitudinal cross-sectional view of the adjustable bed base of FIG. 7 showing the subframe in an inclined position and the deck members co-planar.

FIGS. 12A and 12B show two different positions of the adjustable bed base 12*a*, each with the deck 60 being flat or the deck members being co-planar. FIGS. 12A and 12B also show a method of operation of the adjustable bed base 12*a*. FIG. 12A shows the adjustable bed base 12*a* in a home position with the subframe 36 is its lowered, horizontal position. In this home position, the motorized primary lift actuators 106*a* are fully retracted and not activated. From this home position shown in FIG. 12A, the two front motorized primary linear actuators 106*a* of adjustable bed base 12*a* are activated via remote control (not shown) or an app on a phone (not shown) to expand or lengthen. Such expansion of the front primary linear actuators 106*a* shown by arrow 128 in FIG. 12A, moves the front ramps 116 forwardly. The forward movement of the front ramps 116 by expansion of the two front primary linear actuators 106*a* moves the front ramps 116 forward in the channels 34 of the side rails 24 of stationary frame 16. This forward movement of the front ramps 116 causes the front wheels 104 of the subframe 36 to move upwardly inside the grooves 120 of the front ramps 116. This upward movement of the front wheels 104 raises the front member 40 of subframe 36 in the direction shown by arrow 130 of FIG. 12A to its fully inclined position shown in FIG. 12B. This movement of the front wheels 104 causes the front member 40 of subframe 36 to rise upwardly, thereby pivoting the subframe 36 about pivot axis A to its fully inclined position shown in FIG. 12B. FIG. 12B shows the deck 60 in a flat position and the subframe 36 in its fully inclined position due to full extension of the front primary lift actuators 106*a*.

FIG. 12B illustrates the deck 60 in a flat position with the deck boards being co-planar. However, the deck 60 is in a tilted or inclined position with a front edge 112 of the head deck board 62 being above a rear edge 114 of the head deck board 62. The same is true for each of the deck boards. In the industry this is known as a Reverse Trendelenburg position. When the adjustable bed base 12*a* is in this position shown in FIG. 12B, the subframe 36 and each of the deck boards is inclined at an angle θ which may be up to six degrees relative to horizontal. In this inclined position shown in FIG. 12B, the front primary lift actuators 106*a* are fully extended but the rear primary lift actuators 106*a* are fully retracted.

In each of the positions shown in FIGS. 12A and 12B, the front and rear secondary linear actuators 78, 84, respectively, are in their retracted position and are not activated, thereby resulting in a flat deck 60.

FIG. 12B shows the front primary lift actuators 106*a* being retracted from their fully extended positions (see arrow 132) and the rear primary lift actuators 106*a* being extended from their fully retracted positions (see arrow 134). Such movement of the primary lift actuators 106*a* lowers the front member 40 of subframe 36 as shown by arrow 136 and raises the rear member 42 of subframe 36 upwardly, as shown by arrow 138.

Figure 12C:
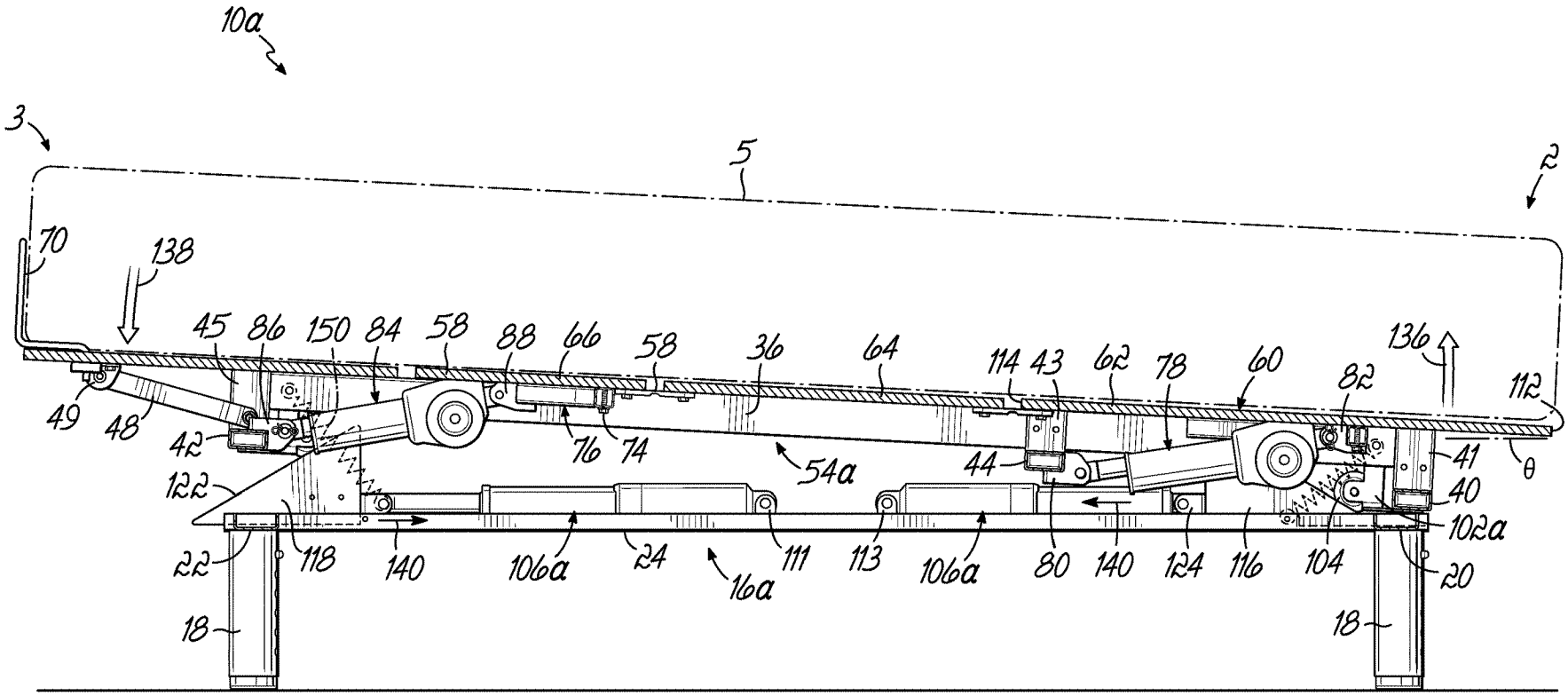
FIG. 12C is a longitudinal cross-sectional view of the adjustable bed base of FIG. 7 showing the subframe in a declined position and the deck members co-planar.

FIG. 12C shows the deck 60 in a flat position with the deck boards being co-planar. However, the deck 60 is in a tilted or declined position with a front edge 112 of the head deck board 62 being below a rear edge 114 of the head deck board 62. The same is true for each of the deck boards. In the industry this is known as a Trendelenburg position. When the adjustable bed base 12*a* is in this position shown in FIG. 12C, the subframe 36 and each of the deck boards is inclined at an angle θ which may be up to six degrees relative to horizontal. In this declined position shown in FIG. 12C, the rear primary lift actuators 106*a* are fully extended but the front To get back to the home position from this fully declined position shown in FIG. 12C, the front primary lift actuators 106*a* are fully retracted as shown by arrows 140.

Figure 13A:
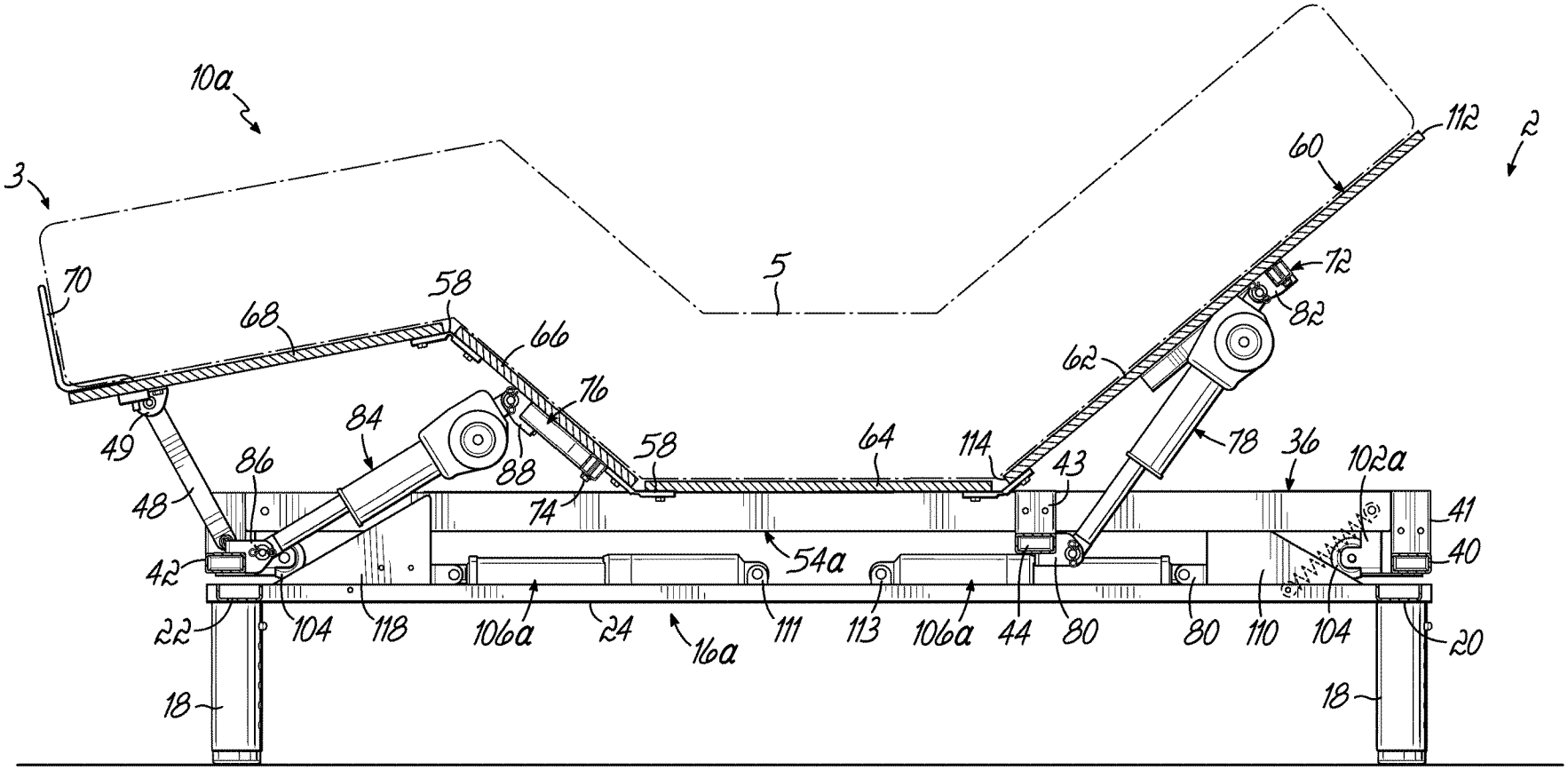
FIG. 13A is a longitudinal cross-sectional view of the adjustable bed base of FIG. 7 showing the subframe in a lowered position and the deck members fully inclined.
Figure 13B:
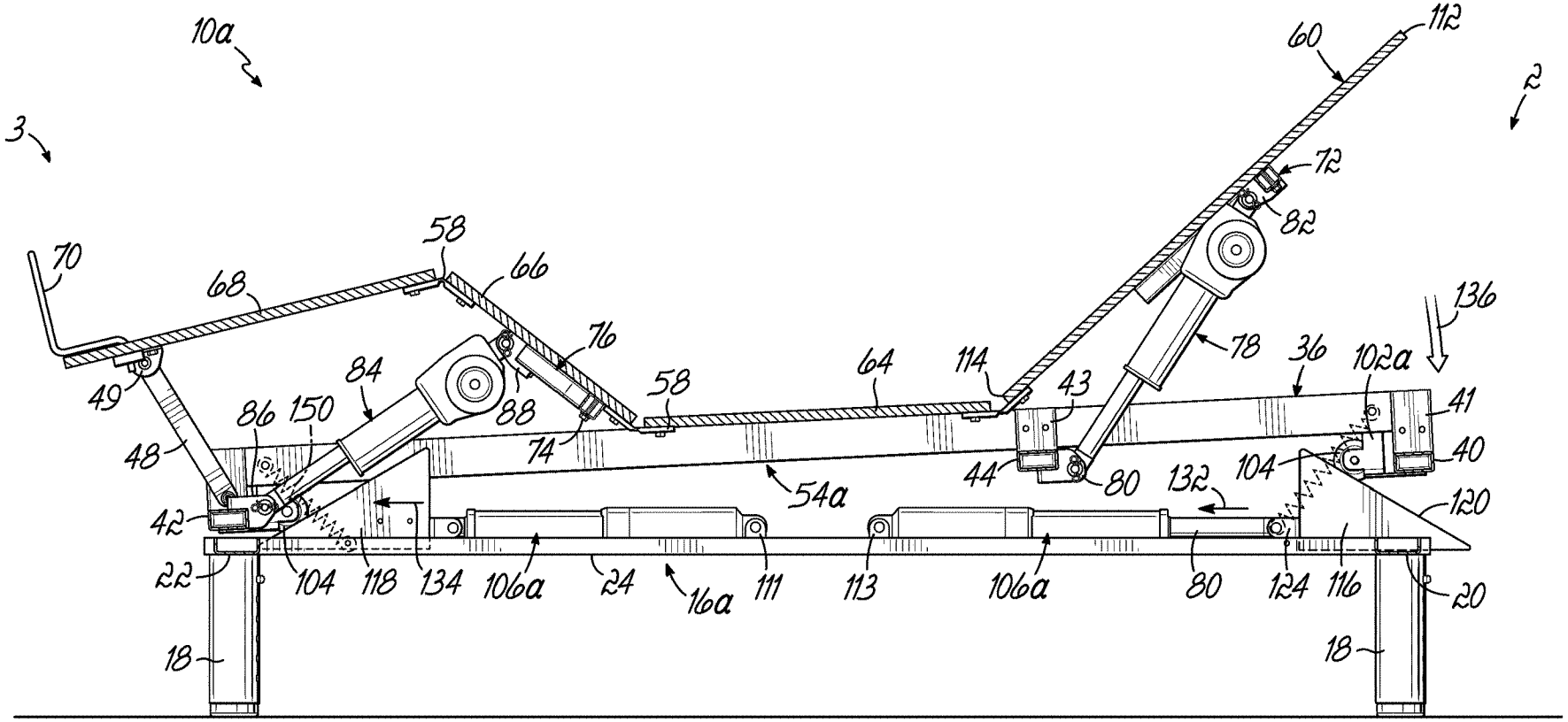
FIG. 13B is a longitudinal cross-sectional view of the adjustable bed base of FIG. 7 showing the subframe in an inclined position and the deck members fully inclined.

FIGS. 13A and 13B correspond to FIGS. 12A and 12B with the subframe 36 in the same respective positions. However, the deck 60 is shown in FIGS. 13A and 13B fully inclined or articulated. In other words, the front and rear secondary linear actuators 78, 84, respectively, are fully extended in FIGS. 13A and 13B.

Figure 13C:
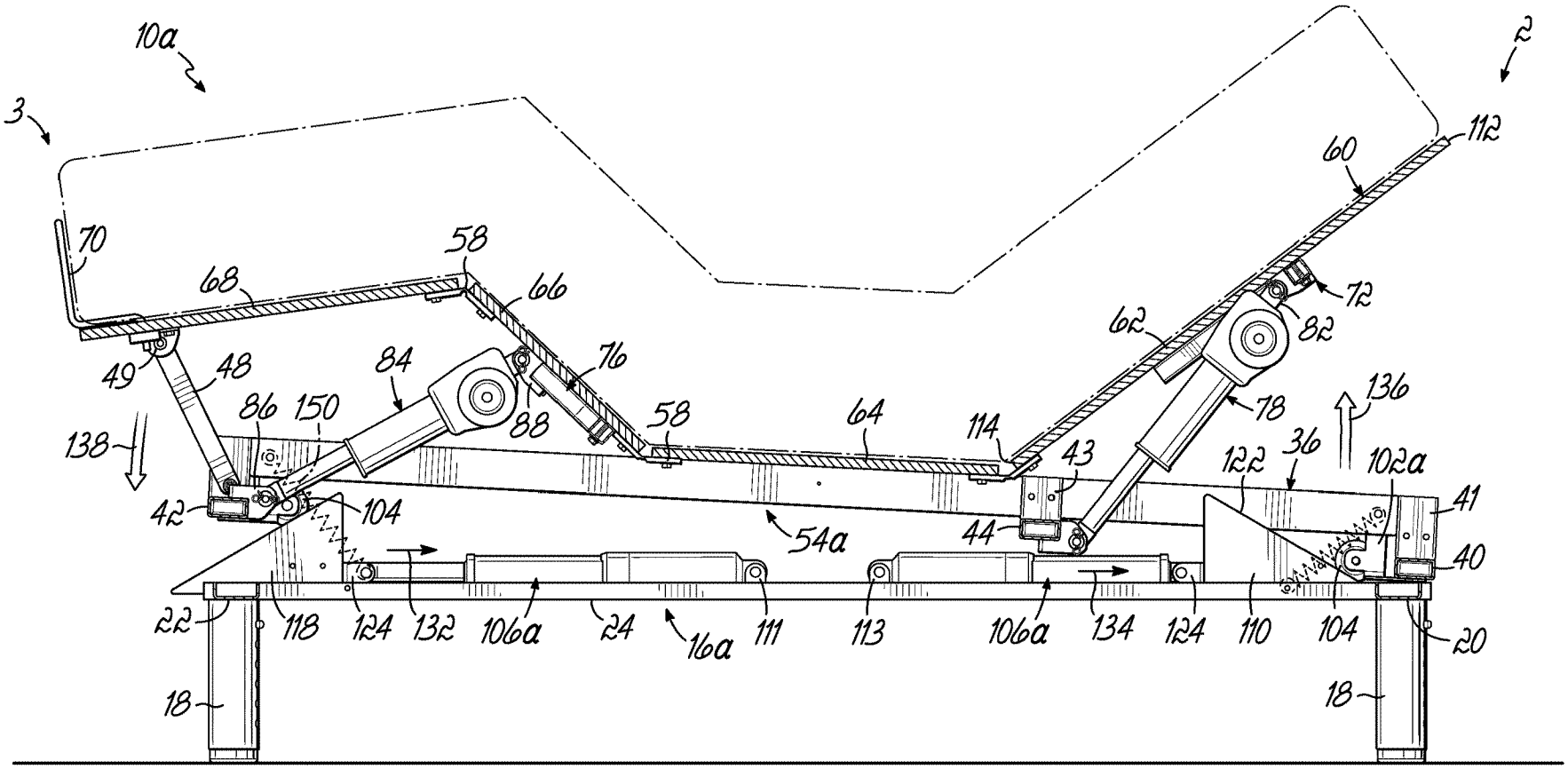
FIG. 13C is a longitudinal cross-sectional view of the adjustable bed base of FIG. 7 showing the subframe in a declined position and the deck members fully inclined.

FIG. 13C corresponds to FIGS. 12C showing the deck of the adjustable bed base 12*a* in a fully inclined position with the subframe 36 is its declined position like FIG. 12C.

Although not shown, regardless of whether the subframe 36 is inclined or declined, only one, rather than both, of the front and rear secondary lift actuators 78, 84, respectively, may be partially or fully extended, thereby moving the deck boards to desired positions.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a generally rectangular stationary frame having opposed side rails, a head rail, a foot rail, a middle rail and a ramp assembly, each of the side rails having a C-shaped cross-section defining a channel;

two front ramps and two rear ramps, each of the ramps being movable inside one of the channels of one of the side rails of the stationary frame;

a subframe moveable relative to the stationary frame, the subframe having opposed side members, a front member, a rear member and a cross member;

two front rotatable wheels, each of the front rotatable wheels being secured to a mounting bracket secured to the front member of the subframe, each of the front rotatable wheels being sized and adapted to move inside a groove of one of the front ramps;

two rear rotatable wheels, each of the rear rotatable wheels being secured to a rear mounting bracket secured to the rear member of the subframe, each of the rear rotatable wheels being sized and adapted to move inside a groove of one of the rear ramps;

a deck comprising a head deck board, a seat deck board, a leg deck board and a foot deck board hinged together, the seat deck board being secured to the subframe;

a head brace secured to the head deck board;

a leg brace secured to the leg deck board;

two front primary linear actuators for moving the front ramps, each of the front primary linear actuators having a first end pivotally secured to an anchor inside one of the side rails of the stationary frame and a second end pivotally secured to a mounting bracket secured to one of the front ramps;

two rear primary linear actuators for moving the rear ramps, each of the rear primary linear actuators having a first end pivotally secured to an anchor inside one of the side rails of the stationary frame and a second end pivotally secured to a mounting bracket secured to one of the rear ramps;

a front secondary linear actuator for inclining the head deck board, the front secondary linear actuator having a first end pivotally secured to a mounting bracket secured to the cross member of the subframe and a second end pivotally secured to the head brace;

a rear secondary linear actuator for inclining the leg and foot deck boards, the rear secondary linear actuator having a first end pivotally secured to a mounting bracket secured to the rear member of the subframe and a second end pivotally secured to the leg brace;

legs secured to the stationary frame for supporting the stationary frame.

2. The adjustable bed base of claim 1, further comprising foot links extending between the rear member of the subframe and brackets secured to the foot deck board.

3. The adjustable bed base of claim 1, wherein the head and leg braces are generally U-shaped.

4. The adjustable bed base of claim 1, wherein the linear actuators are motorized.

5. The adjustable bed base of claim 1, the opposed side members of the subframe are angle irons.

6. The adjustable bed base of claim 1, wherein the deck is tilted when one set of the front and rear primary linear actuators is extended more than the other set of primary linear actuators.

7. The adjustable bed base of claim 1, wherein the deck is articulated when the front and rear secondary linear actuators are fully extended.

8. An adjustable bed base comprising:

a stationary frame having opposed side rails, a head rail, a foot rail and a middle rail, each of the side rails having a C-shaped cross-section defining a channel;

two front ramps and two rear ramps, each of the ramps being movable inside one of the channels of one of the side rails of the stationary frame;

a subframe having opposed side members, a front member, a rear member and a cross member;

rotatable wheels secured to wheel mounting brackets secured to the front and rear members of the subframe, the rotatable wheels being sized and adapted to move along the ramps;

a deck comprising a head deck board, a seat deck board, a leg deck board and a foot deck board hinged together, the seat deck board being secured to the subframe;

a head brace secured to the head deck board;

a leg brace secured to the leg deck board;

a primary linear actuator corresponding to each of the ramps for moving the ramp, the primary linear actuator having a first end pivotally secured to an anchor secured inside one of the side rails of the stationary frame and a second end pivotally secured to a mounting bracket secured to one of the ramps;

a front secondary linear actuator for inclining the head deck board, the front secondary linear actuator having a first end pivotally secured to a mounting bracket secured to the cross member of the subframe and a second end pivotally secured to the head brace; and a rear secondary linear actuator for inclining the leg and foot deck boards, the rear secondary linear actuator having a first end pivotally secured to a mounting bracket secured to the rear member of the subframe and a second end pivotally secured to the leg brace.

9. The adjustable bed base of claim 8, further comprising legs secured to the stationary frame for supporting the stationary frame.

10. The adjustable bed base of claim 9, wherein the linear actuators are motorized.

11. The adjustable bed base of claim 8, wherein springs extend between the side members of the subframe and the side rails of the stationary frame.

12. The adjustable bed base of claim 11, wherein the side members of the subframe extend through the ramps.

13. The adjustable bed base of claim 8, wherein the ramps have grooves in which the wheels move.

14. The adjustable bed base of claim 8, wherein the subframe is inclined when two front primary linear actuators are extended.

15. The adjustable bed base of claim 8, wherein the front and rear members of the subframe are below the side members of the subframe.

16. An adjustable bed base comprising:

a stationary frame having opposed side rails, a head rail, a foot rail and a middle rail, each of the rails having a C-shaped cross-section defining a channel;

a subframe having opposed side members, a front member, a rear member and a cross member extending between the opposed side members, two front ramps and two rear ramps, each of the ramps being movable inside one of the channels of one of the side rails of the stationary frame, two front wheels secured to mounting brackets secured to the front member of the subframe, the front wheels being sized and adapted to move along the front ramps to incline the subframe relative to the stationary frame;

two rear wheels secured to mounting brackets secured to the rear member of the subframe, the rear wheels being sized and adapted to move along the rear ramps to decline the subframe relative to the stationary frame;

a deck comprising a head deck board, a seat deck board, a leg deck board and a foot deck board hinged together, the seat deck board being secured to the subframe;

a head brace secured to the head deck board;

a leg brace secured to the leg deck board;

a primary linear actuator for moving each of the ramps, each primary linear actuator having a first end pivotally secured to an anchor secured inside the channel of the side rail of the stationary frame and a second end pivotally secured to a mounting bracket secured to the ramp;

a front secondary linear actuator for inclining the head deck board, the front secondary linear actuator having a first end pivotally secured to a mounting bracket secured to the cross member of the subframe and a second end pivotally secured to the head brace;

a rear secondary linear actuator for inclining the leg and foot deck boards, the rear secondary linear actuator having a first end pivotally secured to a mounting bracket secured to the rear member of the subframe and a second end pivotally secured to the leg brace.

17. The adjustable bed base of claim 16, further comprising springs secured to the side rail of stationary frame and side member of the subframe.

18. The adjustable bed base of claim 17, wherein each of the wheels is the same size.

19. The adjustable bed base of claim 16, wherein the subframe is horizontal when the primary linear actuators are retracted.

20. The adjustable bed base of claim 16, wherein the subframe is either inclined or declined when two of the four primary linear actuators are extended.

* * * * *